US008228265B2

(12) United States Patent
Origuchi et al.

(10) Patent No.: US 8,228,265 B2
(45) Date of Patent: Jul. 24, 2012

(54) PLASMA DISPLAY DEVICE AND DRIVING METHOD THEREOF

(75) Inventors: Takahiko Origuchi, Osaka (JP); Hidehiko Shoji, Osaka (JP)

(73) Assignee: Panasonic Corporation, Osaka (JP)

( * ) Notice: Subject to any disclaimer, the term of this patent is extended or adjusted under 35 U.S.C. 154(b) by 520 days.

(21) Appl. No.: 12/513,241

(22) PCT Filed: Nov. 28, 2007

(86) PCT No.: PCT/JP2007/072974

§ 371 (c)(1),
(2), (4) Date: May 1, 2009

(87) PCT Pub. No.: WO2008/066084

PCT Pub. Date: Jun. 5, 2008

(65) Prior Publication Data

US 2010/0066721 A1 Mar. 18, 2010

(30) Foreign Application Priority Data

Nov. 28, 2006 (JP) ..... 2006-319842
Nov. 28, 2006 (JP) ..... 2006-319844
Nov. 28, 2006 (JP) ..... 2006-319845
Nov. 28, 2006 (JP) ..... 2006-319846

(51) Int. Cl.
*G09G 3/28* (2006.01)

(52) U.S. Cl. ..... 345/63

(58) Field of Classification Search ..... 345/60–63
See application file for complete search history.

(56) References Cited

U.S. PATENT DOCUMENTS 6,294,875 B1 9/2001 Kurata et al.
7,138,988 B2 11/2006 Kigo et al.
7,142,202 B2 11/2006 Kigo et al.
(Continued)

FOREIGN PATENT DOCUMENTS

EP 1388841 2/2004
(Continued)

OTHER PUBLICATIONS

English language Abstract of JP 2001-184023 A.
(Continued)

*Primary Examiner* — Chanh Nguyen
*Assistant Examiner* — Roy Rabindranath
(74) *Attorney, Agent, or Firm* — Greenblum & Bernstein, P.L.C.

(57) ABSTRACT

A first ramp waveform rising from a first potential (Vi1) to a second potential (Vi2) is applied to a plurality of scan electrodes (SC) in a first half period of a setup period, and a third ramp waveform rising from a fifth potential (a ground potential) to a sixth potential (Vi5, Vi5') is applied to a plurality of sustain electrodes (SU) in a period, which is shorter than the first half period, within the first half period. A second ramp waveform dropping from a third potential (Vi3) to a fourth potential (Vi4) is applied to the plurality of scan electrodes (SC) in the second half period following the first half period, and a fourth ramp waveform dropping from a seventh potential (Ve) to an eighth potential (Vi6, Vi6') is applied to the plurality of sustain electrodes (SU) in a period, which is shorter than the second half period, within the second half period. Then, a peak value of the third ramp waveform and a peak value of the fourth ramp waveform are changed based on a state of a plasma display panel.

5 Claims, 16 Drawing Sheets

U.S. PATENT DOCUMENTS

| | | | | |
|---|---|---|---|---|
| 7,375,722 | B2 | 5/2008 | Kigo et al. | |
| 2002/0118149 | A1 | 8/2002 | Tanaka et al. | |
| 2002/0180669 | A1 | 12/2002 | Kim et al. | |
| 2003/0001804 | A1* | 1/2003 | Naganuma | 345/63 |
| 2003/0107532 | A1 | 6/2003 | Choi | |
| 2004/0027316 | A1* | 2/2004 | Kang et al. | 345/60 |
| 2004/0090395 | A1 | 5/2004 | Park | |
| 2004/0183915 | A1 | 9/2004 | Gotohda et al. | |
| 2004/0246206 | A1 | 12/2004 | Choi | |
| 2005/0093853 | A1 | 5/2005 | Kim | |
| 2005/0237276 | A1 | 10/2005 | Tsuchida et al. | |
| 2006/0176246 | A1 | 8/2006 | Shoji et al. | |
| 2006/0284796 | A1 | 12/2006 | Kigo et al. | |
| 2007/0195051 | A1 | 8/2007 | Ikeda | |
| 2007/0205964 | A1 | 9/2007 | Nagaki | |
| 2007/0222902 | A1 | 9/2007 | Yamate | |
| 2007/0268216 | A1 | 11/2007 | Arai et al. | |
| 2008/0074354 | A1* | 3/2008 | Yahagi et al. | 345/63 |
| 2008/0122746 | A1* | 5/2008 | Kim et al. | 345/60 |
| 2008/0238824 | A1 | 10/2008 | Tsuchida et al. | |
| 2009/0058310 | A1 | 3/2009 | Arai et al. | |
| 2010/0060627 | A1* | 3/2010 | Origuchi et al. | 345/214 |

FOREIGN PATENT DOCUMENTS

| | | | |
|---|---|---|---|
| JP | 2000-242224 | A | 9/2000 |
| JP | 2001-184023 | | 7/2001 |
| JP | 2001-184023 | A | 7/2001 |
| JP | 2002-258794 | | 9/2002 |
| JP | 2003-84712 | | 3/2003 |
| JP | 2003-255888 | | 9/2003 |
| JP | 2004-70359 | | 3/2004 |
| JP | 2004-070359 | A | 3/2004 |
| JP | 2004-140759 | A | 5/2004 |
| JP | 2004-140795 | A | 5/2004 |
| JP | 2004-163884 | | 6/2004 |
| JP | 2004-163884 | A | 6/2004 |
| JP | 2004-361964 | | 12/2004 |
| JP | 2004-361964 | A | 12/2004 |
| JP | 2005-122102 | | 5/2005 |
| JP | 2005-122102 | A | 5/2005 |
| JP | 2005-321680 | A | 11/2005 |
| JP | 2005-326835 | | 11/2005 |
| JP | 2005-326835 | A | 11/2005 |
| KR | 10-2005-0042560 | | 5/2005 |
| KR | 2005-0042560 | | 5/2005 |
| KR | 10 2005 0042560 | * | 5/2010 |

OTHER PUBLICATIONS

U.S. Appl. No. 12/447,701 to Origuchi et al., which was filed on Apr. 29, 2009.
Japan Office action, mail date is Aug. 2, 2011.
English language Abstract of KR 2005-0042560, May 10, 2005.
English language Abstract of JP 2002-258794, Sep. 11, 2002.
English language Abstract of JP 2003-255888, Sep. 10, 2003.
English language Abstract of JP 2003-84712, Mar. 19, 2003.

* cited by examiner

FIG. 9

| LIGHTING RATE OF SUB-FIELD | RISING RAMP WAVEFORM ($Vi_5$, $Vi_5'$) | DROPPING RAMP WAVEFORM ($Vi_6$, $Vi_6'$) | START TIMING OF RISING RAMP WAVEFORM | START TIMING OF DROPPING RAMP WAVEFORM |
|---|---|---|---|---|
| ～5％ | 70V | 90V | 70μs | 140μs |
| 5％～ | 35V | 125V | 100μs | 170μs |

FIG. 12

| VALUE OF APL | RISING RAMP WAVEFORM ($Vh_5$, $Vi_5$, $Vl_5$) | DROPPING RAMP WAVEFORM ($Vh_6$, $Vi_6$, $Vl_6$) | START TIMING OF RISING RAMP WAVEFORM | START TIMING OF DROPPING RAMP WAVEFORM |
|---|---|---|---|---|
| 0～10% | 70V | 90V | 70μs | 140μs |
| 10～30% | 35V | 125V | 100μs | 170μs |
| 30～100% | 0V | 160V | 130μs | 200μs |

FIG. 14

| CUMULATIVE LIGHTING TIME | RISING RAMP WAVEFORM ($Vi_5$, $Vi_5'$) | DROPPING RAMP WAVEFORM ($Vi_6$, $Vi_6'$) | START TIMING OF RISING RAMP WAVEFORM | START TIMING OF DROPPING RAMP WAVEFORM |
|---|---|---|---|---|
| ～500HOURS | 70V | 90V | 70μs | 140μs |
| 500～1500HOURS | 35V | 125V | 100μs | 170μs |
| 1500HOURS～ | 0V | 160V | 130μs | 200μs |

FIG. 16

| PANEL TEMPERATURE | RISING RAMP WAVEFORM ($Vi_5$, $Vi_5'$) | DROPPING RAMP WAVEFORM ($Vi_6$, $Vi_6'$) | START TIMING OF RISING RAMP WAVEFORM | START TIMING OF DROPPING RAMP WAVEFORM |
|---|---|---|---|---|
| ～5℃ | 0V | 160V | 130μs | 200μs |
| 5℃～25℃ | 35V | 125V | 100μs | 170μs |
| 25℃ | 70V | 90V | 70μs | 140μs |

PLASMA DISPLAY DEVICE AND DRIVING METHOD THEREOF

TECHNICAL FIELD

The present invention relates to a plasma display device and a driving method thereof.

BACKGROUND ART

In an AC surface discharge type panel that is typical as a plasma display panel (hereinafter abbreviated as a "panel"), a number of discharge cells are formed between a front plate and a back plate arranged to be opposite to each other.

The front plate includes a front glass substrate, display electrodes composed of a pair of scan electrode and sustain electrode, a dielectric layer and a protective layer. The plurality of display electrodes are formed in parallel with one another on the front glass substrate. The dielectric layer and the protective layer are formed on the front glass substrate so as to cover the display electrodes.

The back plate includes a back glass substrate, data electrodes, a dielectric layer, barrier ribs and phosphor layers. The plurality of data electrodes are formed in parallel with one another on the back glass substrate. The dielectric layer is formed on the back glass substrate so as to cover the data electrodes. Furthermore, the plurality of barrier ribs are formed in parallel with the plurality of data electrodes, respectively, on the dielectric layer. The phosphor layers are formed on a surface of the dielectric layer and side surfaces of the barrier ribs.

Then, the front plate and the back plate are arranged to be opposite to each other such that the plurality of display electrodes intersect with the plurality of data electrodes in three dimensions. A discharge space is formed between the front plate and the back plate. The discharge space is filled with a discharge gas. Here, the discharge cells are formed at respective portions where the display electrodes and the data electrodes face one another. In the panel having such a configuration, ultraviolet rays are generated by a gas discharge in each discharge cell. The ultraviolet rays cause phosphors of R (red), G (green) and B (blue) to be excited and to emit light, thus performing color display.

A sub-field method is employed as a method for driving the panel. JP 2000-242224 A (hereinafter referred to as Patent Document 1) discloses a new driving method of sub-field methods in which light emission that is not involved in a gray scale display is suppressed to the minimum to improve a contrast ratio.

In the following description, one field period is divided into N sub-fields each having a setup period, a write period and a sustain period. The divided N sub-fields are abbreviated as a first SF, a second SF, . . . and an Nth SF. According to the driving method of Patent Document 1, in the N sub-fields excluding the first SF, setup operations are performed only in discharge cells that have lighted up in sustain periods of respective preceding sub-fields.

Specifically, in the first half (a first period) of a setup period of the first SF, a ramp waveform gently rising is applied to the scan electrodes to generate weak discharges, and wall charges necessary for a write operation are formed on each electrode. At this time, excessive wall charges are formed in anticipation of optimization of the wall charges performed later. Then, in the second half (a second period) of the setup period, the ramp waveform gently dropping is applied to the scan electrodes to again generate weak discharges. In this manner, the excessive wall charges stored on each electrode are weakened, so that the amount of the wall charges on each discharge cell is adjusted to an appropriate amount.

In a write period of the first SF, write discharges are generated in discharge cells that are to emit light. Then, in a sustain period of the first SF, sustain pulses are applied to the scan electrodes and the sustain electrodes to generate sustain discharges in the discharge cells in which the write discharges have been induced, and the phosphor layers of the corresponding discharge cells are caused to emit light, thereby performing image display.

In a setup period of a subsequent second SF, a driving waveform that is the same as that in the second half of the setup period of the first SF, that is, a ramp waveform gently dropping is applied to the scan electrodes. Thus, formation of the wall charges necessary for the write operation is performed concurrently with the sustain discharges. This eliminates the necessity of independently providing the first half, which is the same as that in the setup period of the first SF, in the setup period of the second SF.

As described above, the ramp waveform gently dropping is applied to the scan electrodes, so that the weak discharges are generated in the discharge cells in which the sustain discharges have been performed in the first SF. Accordingly, the excessive wall charges stored on each electrode are weakened to be adjusted to wall charges appropriate for each discharge cell. In the discharge cells in which the sustain discharges have not been generated, the weak discharges are not generated since the wall charges are held in a state at the end of the setup period of the first SF.

As described above, the setup operation of the first SF is a setup operation for all cells that causes all the discharge cells to discharge, and the setup operations of the second SF and the subsequent SFs are selective setup operations that set up only the discharge cells in which the sustain discharges have been performed. Accordingly, in the discharge cells that are not involved in image display (the discharge cells that do not emit light) of all the discharge cells, the weak discharges are generated only in the setup period of the first SF, and the weak discharges are not generated in the setup periods of the other SFs. This enables the image display with a high contrast.

In addition, a driving method in which data pulses are applied to the data electrodes in the first period is disclosed in JP 2005-321680 A (hereinafter referred to as Patent Document 2) as a method of stabilizing the setup discharges when the foregoing setup operation for all the cells is performed. According to the driving method of Patent Document 2, in the first period of the setup period for all the cells, a positive data voltage is applied to the data electrodes to generate discharges between the scan electrodes and the sustain electrodes before discharges between the scan electrodes and the data electrodes, so that the setup discharges can be stabilized and image display with an excellent quality can be performed.

Furthermore, JP 2004-163884 A (hereinafter referred to as Patent Document 3) discloses a method of suppressing unnecessary discharges in the setup operation for all the cells to improve the contrast.

According to the driving method of Patent Document 3, the sustain electrodes are separated from a ground terminal and a node (high impedance state) in a certain period, in which the ramp waveform gently rising is applied to the scan electrodes, of the first period. In this case, the ramp waveforms are applied to the scan electrodes and also to the sustain electrodes. This decreases a potential difference between the scan electrodes and the sustain electrodes to suppress unnecessary discharges, thereby improving the contrast.

[Patent Document 1] JP 2000-242224 A
[Patent Document 2] JP 2005-321680 A
[Patent Document 3] JP 2004-163884 A

DISCLOSURE OF THE INVENTION

Problems to be Solved by the Invention

In recent years, the number of discharge cells has increased with higher precision and a larger screen of a panel. Therefore, when a charge adjustment is not optimally performed in the above-described setup operation, problems would occur in image display.

As described above, in the driving method of Patent Document 2, the charge adjustment is performed between the scan electrodes and the sustain electrodes or between the scan electrodes and the data electrodes in the setup operation for all the cells. The charge adjustment of the scan electrodes is simultaneously performed by the ramp waveform applied to the scan electrodes.

At this time, the data pulses are applied to the data electrodes in the first period of the setup discharge. In this case, the potential difference between the scan electrodes and the data electrodes is decreased. Accordingly, the discharges between the scan electrodes and the sustain electrodes are generated before the discharges between the scan electrodes and the data electrodes. This stabilizes the setup discharges.

Therefore, the peak value of the rising ramp waveform of the scan electrodes in the first period is required to be set at such a value that the wall charges can be sufficiently stored between the scan electrodes and the data electrodes by a potential difference between the peak value of the rising ramp waveform of the scan electrodes and the voltage of the data pulses applied to the data electrodes.

Meanwhile, when the data pulses are applied to the data electrodes in the first period, the sustain electrodes are grounded to 0 V. Therefore, when the peak value of the rising ramp of the scan electrodes in the first period is increased, the potential difference between the scan electrodes and the sustain electrodes is increased, generating a strong discharge. This results in a low contrast.

On the other hand, as in the driving method of Patent Document 3, when the sustain electrodes are brought into the high impedance state and the ramp waveform is applied to the sustain electrodes during the application of the ramp waveform to the scan electrodes in the first period, a significant increase in the potential difference between the scan electrodes and the sustain electrodes is suppressed. This suppresses generation of the strong discharges and improves the contrast.

In this case, however, since the wall charges stored in the sustain electrodes are reduced, the write discharges in the write period following the setup period are destabilized. As a result, problems would occur in the image display.

An object of the present invention is to provide a plasma display device and a driving method thereof in which the contrast of the image is sufficiently improved and problems in the image display are sufficiently prevented.

Means for Solving the Problems (1) According to an aspect of the present invention, a plasma display device includes a plasma display panel including a plurality of discharge cells at intersections of respective pluralities of scan electrodes and sustain electrodes and a plurality of data electrodes, and a driving device that drives the plasma display panel by a sub-field method in which one field period includes a plurality of sub-fields, the driving device includes a scan electrode driving circuit that drives the plurality of scan electrodes, and a sustain electrode driving circuit that drives the plurality of sustain electrodes, the scan electrode driving circuit applies a first ramp waveform rising from a first potential to a second potential to the plurality of scan electrodes in a first period within a setup period of at least one sub-field of the plurality of sub-fields, and applies a second ramp waveform dropping from a third potential to a fourth potential to the plurality of scan electrodes in a second period following the first period, and the sustain electrode driving circuit applies a third ramp waveform rising from a fifth potential to a sixth potential to the plurality of sustain electrodes in a third period, which is shorter than the first period, within the first period, applies a fourth ramp waveform dropping from a seventh potential to an eighth potential to the plurality of sustain electrodes in a fourth period, which is shorter than the second period, within the second period, and changes a peak value of the third ramp waveform and a peak value of the fourth ramp waveform based on a state of the plasma display panel.

In this plasma display device, the first ramp waveform rising from the first potential to the second potential is applied to the plurality of scan electrodes by the scan electrode driving circuit in the first period within the setup period of at least one sub-field of the plurality of sub-fields. Then, the third ramp waveform rising from the fifth potential to the sixth potential is applied to the plurality of sustain electrodes by the sustain electrode driving circuit in the third period, which is shorter than the first period, within the first period.

Thus, an increase in a potential difference between the plurality of scan electrodes and the plurality of sustain electrodes is suppressed in the third period. Therefore, setup discharges are not generated between the plurality of scan electrodes and the plurality of sustain electrodes. Since a period of generation of the setup discharges in the first period is shortened, light emission luminances of the plurality of discharge cells are suppressed. This results in an improved contrast. In this case, the amount of wall charges stored in the plurality of scan electrodes and the plurality of sustain electrodes is decreased.

Moreover, the second ramp waveform dropping from the third potential to the fourth potential is applied to the plurality of scan electrodes in the second period following the first period for the set up discharges. Then, the fourth ramp waveform dropping from the seventh potential to the eighth potential is applied to the plurality of sustain electrodes by the sustain electrode driving circuit in the fourth period, which is shorter than the second period, within the second period.

Accordingly, the increase in a potential difference between the plurality of scan electrodes and the plurality of sustain electrodes is suppressed in the fourth period. Therefore, the setup discharges are not generated between the plurality of scan electrodes and the plurality of sustain electrodes. Since a period of generation of the setup discharges in the second period is shortened, the amount of reduction of the wall charges stored in the plurality of scan electrodes and the plurality of sustain electrodes in the first period is decreased.

Moreover, the peak value of the third ramp waveform and the peak value of the fourth ramp waveform are changed based on the state of the plasma display panel, so that the wall charges between the scan electrodes and the sustain electrodes and the wall charges between the scan electrodes and the data electrodes can be independently controlled, respectively, depending on the state of the plasma display panel.

Thus, the wall charges on the plurality of scan electrodes and the plurality of sustain electrodes can be adjusted to values sufficiently suitable for write discharges.

This improves the contrast while stabilizing a write operation. In addition, the stable write operation can suppress erroneous discharges in a sustain period. As a result, images with a high contrast and an excellent display quality can be displayed.

(2) The plasma display device may further include a detector that detects a lighting rate of the plasma display panel as the state of the plasma display panel, and the sustain electrode driving circuit may change the peak value of the third ramp waveform and the peak value of the fourth ramp waveform based on the lighting rate detected by the detector.

In this case, the peak value of the third ramp waveform and the peak value of the fourth ramp waveform are changed based on the lighting rate of the plasma display panel, so that the wall charges between the scan electrodes and the sustain electrodes and the wall charges between the scan electrodes and the data electrodes can be independently controlled, respectively, depending on the lighting rate.

Thus, the wall charges on the plurality of scan electrodes and the plurality of sustain electrodes can be adjusted to the values sufficiently suitable for the write discharges.

This improves the contrast while stabilizing the write operation. In addition, the stable write operation can suppress erroneous discharges in the sustain period. As a result, images with the high contrast and the excellent display quality can be displayed.

(3) The plasma display device may further include a detector that detects an average luminance level of an image to be displayed on the plasma display panel as the state of the plasma display panel, and the sustain electrode driving circuit may change the peak value of the third ramp waveform and the peak value of the fourth ramp waveform based on the average luminance level detected by the detector.

In this case, the peak value of the third ramp waveform and the peak value of the fourth ramp waveform are changed based on the average luminance level of the image to be displayed on the plasma display panel, so that the wall charges between the scan electrodes and the sustain electrodes and the wall charges between the scan electrodes and the data electrodes can be independently controlled, respectively, depending on the average luminance level.

Thus, the wall charges on the plurality of scan electrodes and the plurality of sustain electrodes can be adjusted to the values sufficiently suitable for the write discharges.

This improves the contrast while stabilizing the write operation. In addition, the stable write operation can suppress erroneous discharges in the sustain period. As a result, images with the high contrast and the excellent display quality can be displayed.

(4) The sustain electrode driving circuit may make the peak value of the third ramp waveform and the peak value of the fourth ramp waveform higher as the average luminance level detected by the detector is lower.

In this case, when the average luminance level is low, a light emission luminance in the setup period is sufficiently reduced. Thus, a contrast is sufficiently improved even in a video of a low luminance.

(5) The plasma display device may further include a detector that detects a cumulative lighting time of the plasma display panel as the state of the plasma display panel, and the sustain electrode driving circuit may change the peak value of the third ramp waveform and the peak value of the fourth ramp waveform based on the cumulative lighting time detected by the detector.

In this case, the peak value of the third ramp waveform and the peak value of the fourth ramp waveform are changed depending on the cumulative lighting time of the plasma display panel, so that the wall charges between the scan electrodes and the sustain electrodes and the wall charges between the scan electrodes and the data electrodes can be independently controlled, respectively, depending on the cumulative lighting time.

Thus, the wall charges on the plurality of scan electrodes and the plurality of sustain electrodes can be adjusted to the values sufficiently suitable for the write discharges.

This improves the contrast while stabilizing the write operation. In addition, the stable write operation can suppress erroneous discharges in the sustain period. As a result, images with the high contrast and the excellent display quality can be displayed.

(6) The plasma display device may further include a detector that detects a temperature of the plasma display panel as the state of the plasma display panel, and the sustain electrode driving circuit may change the peak value of the third ramp waveform and the peak value of the fourth ramp waveform based on the temperature detected by the detector.

In this case, the peak value of the third ramp waveform and the peak value of the fourth ramp waveform are changed based on the temperature of the plasma display panel, so that the wall charges between the scan electrodes and the sustain electrodes and the wall charges between the scan electrodes and the data electrodes can be independently controlled, respectively, depending on the temperature.

Thus, the wall charges on the plurality of scan electrodes and the plurality of sustain electrodes can be adjusted to the values sufficiently suitable for the write discharges.

This improves the contrast while stabilizing the write operation. In addition, the stable write operation can suppress erroneous discharges in the sustain period. As a result, images with the high contrast and the excellent display quality can be displayed.

(7) The sustain electrode driving circuit may bring the plurality of sustain electrodes into a floating state in the third period and the fourth period.

When the plurality of sustain electrodes are in the floating state, the potential of the plurality of sustain electrodes varies according to the variations of the potential of the plurality of scan electrodes by capacitive coupling. Accordingly, in the third period and the fourth period, the potential of the plurality of sustain electrodes varies according to the first ramp waveform and the second ramp waveform applied to the plurality of scan electrodes.

Thus, the third ramp waveform and the fourth ramp waveform can be applied to the plurality of sustain electrodes by a simple circuit configuration. As a result, an increase in cost can be suppressed.

(8) According to another aspect of the present invention, a driving method of a plasma display panel that drives the plasma display panel including a plurality of discharge cells at intersections of respective pluralities of scan electrodes and sustain electrodes and a plurality of data electrodes by a sub-field method in which one field period includes a plurality of sub-fields includes the steps of applying a first ramp waveform rising from a first potential to a second potential to the plurality of scan electrodes in a first period within a setup period of at least one sub-field of the plurality of sub-fields, applying a second ramp waveform dropping from a third potential to a fourth potential to the plurality of scan electrodes in a second period following the first period, applying a third ramp waveform rising from a fifth potential to a sixth potential to the plurality of sustain electrodes in a third period, which is shorter than the first period, within the first period, applying a fourth ramp waveform dropping from a seventh potential to an eighth potential to the plurality of sustain electrodes in a fourth period, which is shorter than the second period, within the second period, and changing a peak value of the third ramp waveform and a peak value of the fourth ramp waveform based on a state of the plasma display panel.

In this driving method of the plasma display panel, the first ramp waveform rising from the first potential to the second potential is applied to the plurality of scan electrodes in the first period within the setup period of at least one sub-field of the plurality of sub-fields. Then, the third ramp waveform rising from the fifth potential to the sixth potential is applied to the plurality of sustain electrodes in the third period, which is shorter than the first period, within the first period.

Thus, an increase in a potential difference between the plurality of scan electrodes and the plurality of sustain electrodes is suppressed in the third period. Therefore, setup discharges are not generated between the plurality of scan electrodes and the plurality of sustain electrodes. Since a period of generation of the setup discharges in the first period is shortened, light emission luminances of the plurality of discharge cells are suppressed. This results in an improved contrast. In this case, the amount of wall charges stored in the plurality of scan electrodes and the plurality of sustain electrodes is decreased.

Moreover, the second ramp waveform dropping from the third potential to the fourth potential is applied to the plurality of scan electrodes in the second period following the first period for the set up discharges. Then, the fourth ramp waveform dropping from the seventh potential to the eighth potential is applied to the plurality of sustain electrodes in the fourth period, which is shorter than the second period, within the second period.

Accordingly, the increase in the potential difference between the plurality of scan electrodes and the plurality of sustain electrodes is suppressed in the fourth period. Therefore, the setup discharges are not generated between the plurality of scan electrodes and the plurality of sustain electrodes. Since a period of generation of the setup discharges in the second period is shortened, the amount of reduction of the wall charges stored in the plurality of scan electrodes and the plurality of sustain electrodes in the first period is decreased.

Moreover, the peak value of the third ramp waveform and the peak value of the fourth ramp waveform are changed based on the state of the plasma display panel, so that the wall charges between the scan electrodes and the sustain electrodes and the wall charges between the scan electrodes and the data electrodes can be independently controlled, respectively, depending on the state of the plasma display panel.

Thus, the wall charges on the plurality of scan electrodes and the plurality of sustain electrodes can be adjusted to values sufficiently suitable for write discharges.

This improves the contrast while stabilizing a write operation. In addition, the stable write operation can suppress erroneous discharges in a sustain period. As a result, images with a high contrast and an excellent display quality can be displayed.

(9) According to still another aspect of the present invention, a plasma display device includes a plasma display panel including a plurality of discharge cells at intersections of respective pluralities of scan electrodes and sustain electrodes and a plurality of data electrodes, and a driving device that drives the plasma display panel by a sub-field method in which one field period includes a plurality of sub-fields, the driving device includes a scan electrode driving circuit that drives the plurality of scan electrodes, and a sustain electrode driving circuit that drives the plurality of sustain electrodes, the scan electrode driving circuit applies a first ramp waveform that rises to the plurality of scan electrodes in a first half period within a setup period of at least one sub-field of the plurality of sub-fields, and applies a second ramp waveform that drops to the plurality of scan electrodes in a second half period following the first half period, and the sustain electrode driving circuit applies a third ramp waveform that rises to the plurality of sustain electrodes in the first half period, applies a fourth ramp waveform that drops to the plurality of sustain electrodes in the second half period, and changes a peak value of the third ramp waveform and a peak value of the fourth ramp waveform based on a state of the plasma display panel.

In this plasma display device, the first ramp waveform that rises is applied to the plurality of scan electrodes by the scan electrode driving circuit in the first half period within the setup period of at least one sub-field of the plurality of sub-fields. In addition, the third ramp waveform that rises is applied to the plurality of sustain electrodes by the sustain electrode driving circuit in the first half period.

Thus, an increase in a potential difference between the plurality of scan electrodes and the plurality of sustain electrodes is suppressed when the first ramp waveform is applied to the plurality of scan electrodes and the third ramp waveform is applied to the plurality of sustain electrodes in the first half period. Therefore, the setup discharges are not generated between the plurality of scan electrodes and the plurality of sustain electrodes. Since a period of generation of the setup discharges in the first half period is shortened, light emission luminances of the plurality of discharge cells are suppressed. This results in an improved contrast. In this case, the amount of wall charges stored in the plurality of scan electrodes and the plurality of sustain electrodes is decreased.

Moreover, the second ramp waveform that drops is applied to the plurality of scan electrodes in the second half period following the first half period for the setup discharges. In the second half period, the fourth ramp waveform that drops is applied to the plurality of sustain electrodes by the sustain electrode driving circuit.

Accordingly, the increase in the potential difference between the plurality of scan electrodes and the plurality of sustain electrodes is suppressed when the second ramp waveform is applied to the plurality of scan electrodes and the fourth ramp waveform is applied to the plurality of sustain electrodes in the second half period. Therefore, the setup discharges are not generated between the plurality of scan electrodes and the plurality of sustain electrodes. Since a period of generation of the setup discharges in the second half period is shortened, the amount of reduction of the wall charges stored in the plurality of scan electrodes and the plurality of sustain electrodes in the first half period is decreased.

Moreover, the peak value of the third ramp waveform and the peak value of the fourth ramp waveform are changed based on the state of the plasma display panel, so that the wall charges between the scan electrodes and the sustain electrodes and the wall charges between the scan electrodes and the data electrodes can be independently controlled, respectively, depending on the state of the plasma display panel.

Thus, the wall charges on the plurality of scan electrodes and the plurality of sustain electrodes can be adjusted to values sufficiently suitable for write discharges.

This improves the contrast while stabilizing a write operation. In addition, the stable write operation can suppress erroneous discharges in a sustain period. As a result, images with a high contrast and an excellent display quality can be displayed.

(10) According to yet another aspect of the present invention, a driving method of a plasma display panel that drives the plasma display panel including a plurality of discharge cells at intersections of respective pluralities of scan electrodes and sustain electrodes and a plurality of data electrodes by a sub-field method in which one field period includes a plurality of sub-fields includes the steps of applying a first ramp waveform that rises to the plurality of scan electrodes in a first half period within a setup period of at least one sub-field of the plurality of sub-fields, applying a second ramp waveform that drops to the plurality of scan electrodes in a second half period following the first half period, applying a third ramp waveform that rises to the plurality of sustain electrodes in the first half period, applying a fourth ramp waveform that drops to the plurality of sustain electrodes in the second half period, and changing a peak value of the third ramp waveform and a peak value of the fourth ramp waveform based on a state of the plasma display panel.

In this driving method of the plasma display panel, the first ramp waveform that rises is applied to the plurality of scan electrodes in the first half period within the setup period of at least one sub-field of the plurality of sub-fields. In addition, the third ramp waveform that rises is applied to the plurality of sustain electrodes in the first half period.

Thus, an increase in a potential difference between the plurality of scan electrodes and the plurality of sustain electrodes is suppressed when the first ramp waveform is applied to the plurality of scan electrodes and the third ramp waveform is applied to the plurality of sustain electrodes in the first half period. Therefore, setup discharges are not generated between the plurality of scan electrodes and the plurality of sustain electrodes. Since a period of generation of the setup discharges in the first half period is shortened, light emission luminances of the plurality of discharge cells are suppressed. This results in an improved contrast. In this case, the amount of wall charges stored in the plurality of scan electrodes and the plurality of sustain electrodes is decreased.

Moreover, the second ramp waveform that drops is applied to the plurality of scan electrodes in the second half period following the first half period for the setup discharges. In the second half period, the fourth ramp waveform that drops is applied to the plurality of sustain electrodes by the sustain electrode driving circuit.

Accordingly, the increase in the potential difference between the plurality of scan electrodes and the plurality of sustain electrodes is suppressed when the second ramp waveform is applied to the plurality of scan electrodes and the fourth ramp waveform is applied to the plurality of sustain electrodes in the second half period. Therefore, the setup discharges are not generated between the plurality of scan electrodes and the plurality of sustain electrodes. Since a period of generation of the setup discharges in the second half period is shortened, the amount of reduction of the wall charges stored in the plurality of scan electrodes and the plurality of sustain electrodes in the first half period is decreased.

Moreover, the peak value of the third ramp waveform and the peak value of the fourth ramp waveform are changed based on the state of the plasma display panel, so that the wall charges between the scan electrodes and the sustain electrodes and the wall charges between the scan electrodes and the data electrodes can be independently controlled, respectively, depending on the state of the plasma display panel.

Thus, the wall charges on the plurality of scan electrodes and the plurality of sustain electrodes can be adjusted to values sufficiently suitable for write discharges.

This improves the contrast while stabilizing a write operation. In addition, the stable write operation can suppress erroneous discharges in a sustain period. As a result, images with a high contrast and an excellent display quality can be displayed.

The sustain electrode driving circuit may gradually change the peak value of the third ramp waveform and the peak value of the fourth ramp waveform based on the lighting rate detected by the detector.

In this case, since the light emission luminance in the setup period gradually varies, variations in the light emission luminance in the setup period are not visually recognized by a viewer. This causes the display quality to be further excellent.

The sustain electrode driving circuit may change the peak value of the third ramp waveform from a first value to a second value while changing the peak value of the fourth ramp waveform from a third value to a fourth value when the lighting rate detected by the detector changes from a value smaller than a first threshold value to a value not less than the first threshold value, and may change the peak value of the third ramp waveform from the second value to the first value while changing the peak value of the fourth ramp waveform from the fourth value to the third value when the lighting rate detected by the detector changes from a value larger than a second threshold value that is smaller than the first threshold value to a value not more than the second threshold value.

In this case, the peak value of the third ramp waveform and the peak value of the fourth ramp waveform are gradually changed while having hysteresis characteristics. This sufficiently improves the display quality.

The sustain electrode driving circuit may gradually change the peak value of the third ramp waveform and the peak value of the fourth ramp waveform when the lighting rate detected by the detector changes from the value smaller than the first threshold value to the value not less than the first threshold value and when the lighting rate detected by the detector changes from the value larger than the second threshold value to the value not more than the second threshold value.

In this case, the peak value of the third ramp waveform and the peak value of the fourth ramp waveform are gradually changed while having the hysteresis characteristics. This sufficiently improves the display quality.

The sustain electrode driving circuit may gradually change the peak value of the third ramp waveform and the peak value of the fourth ramp waveform based on the average luminance level detected by the detector.

In this case, since the light emission luminance in the setup period gradually varies, the variations in the light emission luminance in the setup period are not visually recognized by the viewer. This causes the display quality to be further excellent.

The sustain electrode driving circuit may change the peak value of the third ramp waveform from the first value to the second value while changing the peak value of the fourth ramp waveform from the third value to the fourth value when the average luminance level detected by the detector changes from a value smaller than a first threshold value to a value not less than the first threshold value, and may change the peak value of the third ramp waveform from the second value to the first value while changing the peak value of the fourth ramp waveform from the fourth value to the third value when the average luminance level detected by the detector changes from a value larger than a second threshold value that is smaller than the first threshold value to a value not more than the second threshold value.

In this case, the changes in the peak value of the third ramp waveform and the peak value of the fourth rap waveform have hysteresis characteristics. This prevents the light emission luminance in the setup period from being frequently switched. This causes the display quality to be further excellent.

The sustain electrode driving circuit may gradually change the peak value of the third ramp waveform and the peak value of the fourth ramp waveform when the average luminance level detected by the detector changes from the value smaller than the first threshold value to the value not less than the first threshold value and when the average luminance level detected by the detector changes from the value larger than the second threshold value to the value not more than the second threshold value.

In this case, the peak value of the third ramp waveform and the peak value of the fourth ramp waveform gradually vary while having hysteresis characteristics. This sufficiently improves the display quality.

The sustain electrode driving circuit may change the peak value of the third ramp waveform and the peak value of the fourth ramp waveform when the plasma display panel is turned off after the lighting rate cumulative lighting time detected by the detector exceeds a threshold value and the plasma display panel is then turned on.

In this case, the light emission luminance in the setup period does not vary when the viewer is viewing the video, and the light emission luminance in the setup period varies when the viewer turns on the plasma display panel. Accordingly, the variations in the light emission luminance in the setup period are not visually recognized by the viewer. This prevents degradation in the display quality.

The sustain electrode driving circuit may make the peak value of the third ramp waveform and the peak value of the fourth ramp waveform smaller when the lighting rate cumulative lighting time detected by the detector exceeds the threshold value.

In this case, the discharge start voltage between the scan electrodes and the sustain electrodes in discharge spaces of the discharge cells becomes higher as the cumulative lighting time is lengthened, so that the setup discharges are unlikely to be generated. Thus, the peak value of the third ramp waveform and the peak value of the fourth ramp waveform are decreased when the cumulative lighting time is long, thus allowing the setup discharges to be reliably generated in the setup period.

The sustain electrode driving circuit may gradually change the peak value of the third ramp waveform and the peak value of the fourth ramp waveform based on the temperature detected by the detector.

In this case, since the light emission luminance in the setup period gradually varies, the variations in the light emission luminance in the setup period are not visually recognized by the viewer. This causes the display quality to be further excellent.

The sustain electrode driving circuit may change the peak value of the third ramp waveform from a first value to a second value while changing the peak value of the fourth ramp waveform from a third value to a fourth value when the temperature detected by the detector changes from a value smaller than a first threshold value to a value not less than the first threshold value, and may change the peak value of the third ramp waveform from the second value to the first value while changing the peak value of the fourth ramp waveform from the fourth value to the third value when the temperature detected by the detector changes from a value larger than a second threshold value that is smaller than the first threshold value to a value not more than the second threshold value.

In this case, the changes in the peak value of the third ramp waveform and the peak value of the fourth ramp waveform have the hysteresis characteristics. This prevents the light emission luminance in the setup period from being frequently switched. This causes the display quality to be further excellent.

The sustain electrode driving circuit may gradually change the peak value of the third ramp waveform and the peak value of the fourth ramp waveform when the temperature detected by the detector changes from the value smaller than the first threshold value to the value not less than the first threshold value and when the temperature detected by the detector changes from the value larger than the second threshold value to the value not more than the second threshold value.

In this case, the peak value of the third ramp waveform and the peak value of the fourth ramp waveform are gradually changed while having the hysteresis characteristics. This sufficiently improves the display quality.

Effects of the Invention

According to a plasma display device and a driving method thereof in the present invention, a contrast of an image is sufficiently improved while problems in an image display are sufficiently prevented, allowing a high-quality image to be obtained.

BRIEF DESCRIPTION OF THE DRAWINGS

FIG. 9 is a table showing an example of a relationship between lighting rates of a sub-field and application timings of a ramp waveform to the sustain electrodes.

FIG. 12 is a table showing an example of the application timings of the ramp waveform to the sustain electrodes set depending on a value of an APL detected by an APL detecting circuit.

FIG. 14 is a table showing an example of the application timings of the ramp waveform to the sustain electrodes and the peak values of the ramp waveform set depending on a cumulative lighting time detected by a lighting time detector.

FIG. 16 is a table showing an example of the application timings of the ramp waveform to the sustain electrodes SU and the peak values of the ramp waveform set depending on a temperature detected by a temperature detector.

BEST MODE FOR CARRYING OUT THE INVENTION

Figure 1:
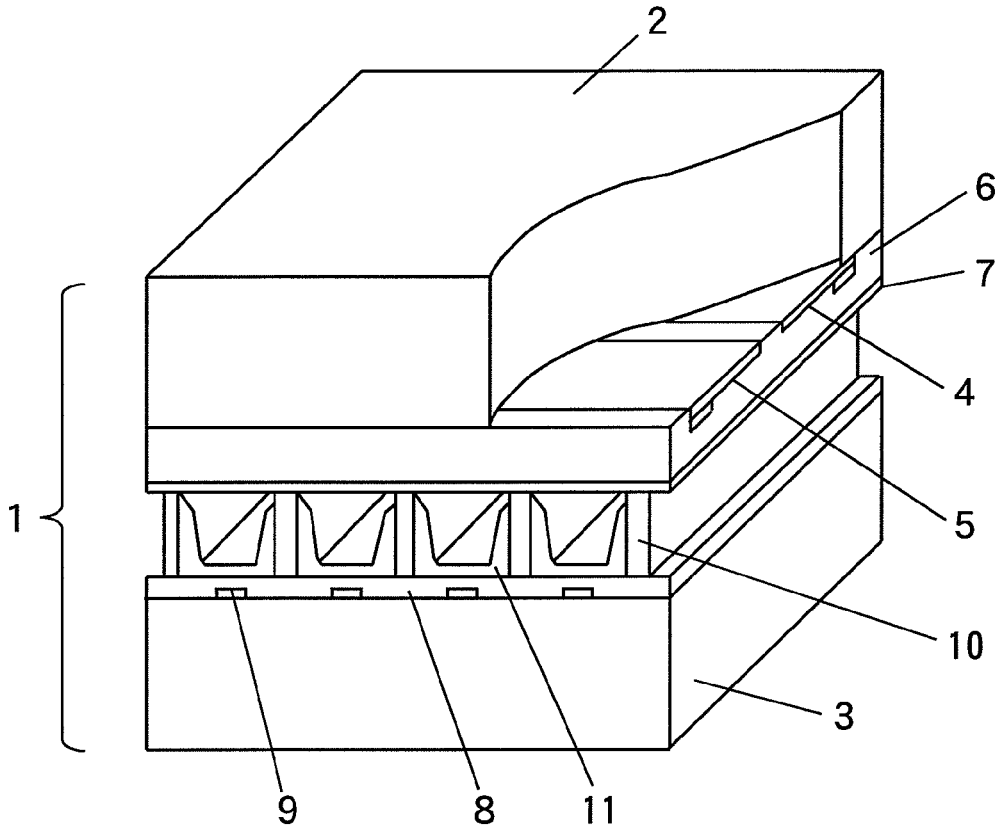
FIG. 1 is a perspective view showing principal parts of a plasma display used in a first embodiment.

The embodiments of the present invention will be described in detail referring to the drawings. The embodiments below describe a plasma display device and a driving method thereof.

In the following description, as long as a specific explanation is not made, the peak value of a ramp waveform means a maximum amount of variation of the voltage of the ramp waveform gently rising or dropping with time, which is, for example, a difference value between a potential at a starting point of applying the ramp waveform and a potential at an ending point of applying the ramp waveform.

First Embodiment

FIG. 1 is a perspective view showing principal parts of the plasma display used in a first embodiment. The plasma display panel (hereinafter abbreviated as the panel) 1 includes a front substrate 2 and a back substrate 3 that are made of glasses and arranged to be opposite to each other. A discharge space is formed between the front substrate 2 and the back substrate 3. A plurality of pairs of scan electrodes 4 and sustain electrodes 5 are formed in parallel with one another on the front substrate 2. Each pair of scan electrode 4 and sustain electrode 5 constitutes a display electrode. A dielectric layer 6 is formed so as to cover the scan electrodes 4 and the sustain electrodes 5, and a protective layer 7 is formed on the dielectric layer 6.

A plurality of data electrodes 9 covered with an insulator layer 8 are provided on the back substrate 3. Barrier ribs 10 in a striped shape extending in a direction parallel to the data electrodes 9 are provided on the insulator layer 8. Phosphor layers 11 are provided on a surface of the insulator layer 8 and side surfaces of the barrier ribs 10. Then, the front substrate 2 and the back substrate 3 are arranged to be opposite to each other such that the plurality of pairs of scan electrodes 4 and sustain electrodes 5 vertically intersect with the plurality of data electrodes 9, and the discharge space is formed between the front substrate 2 and the back substrate 3. The discharge space is filled with a mixed gas of neon and xenon, for example, as a discharge gas. Note that the configuration of the panel is not limited to that described in the foregoing. For example, a configuration including the barrier ribs in a shape of a number sign may be employed.

The above-mentioned phosphor layers 11 include R (red), G (green) and B (blue) phosphor layers, any of which is provided in each discharge cell. One pixel on the panel 1 is constituted by three discharge cells including phosphors of R, G and B, respectively.

Figure 2:
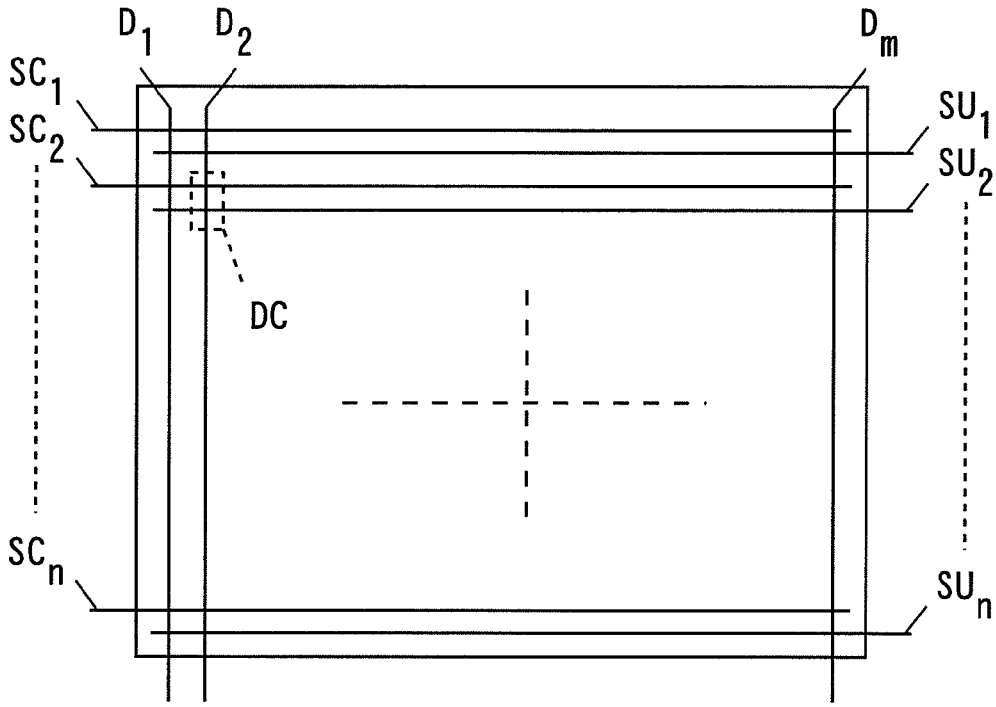
FIG. 2 is a diagram showing an arrangement of electrodes of a panel in the first embodiment.

FIG. 2 is a diagram showing an arrangement of electrodes of the panel in the first embodiment. Along a row direction, n scan electrodes $SC_1$ to $SC_n$ (the scan electrodes 4 of FIG. 1) and n sustain electrodes $SU_1$ to $SU_n$ (the sustain electrodes 5 of FIG. 1) are arranged, and along a column direction, m data electrodes $D_1$ to Dm (the data electrodes 9 of FIG. 1) are arranged. Here, n and m are natural numbers of not less than two, respectively. Then, a discharge cell DC is formed at an intersection of a pair of scan electrode $SC_i$ and sustain electrode $SU_i$ and one data electrode $D_j$. Accordingly, m×n discharge cells are formed in the discharge space. Note that i is an arbitrary integer of 1 to n, and j is an arbitrary integer of 1 to m.

Figure 3:
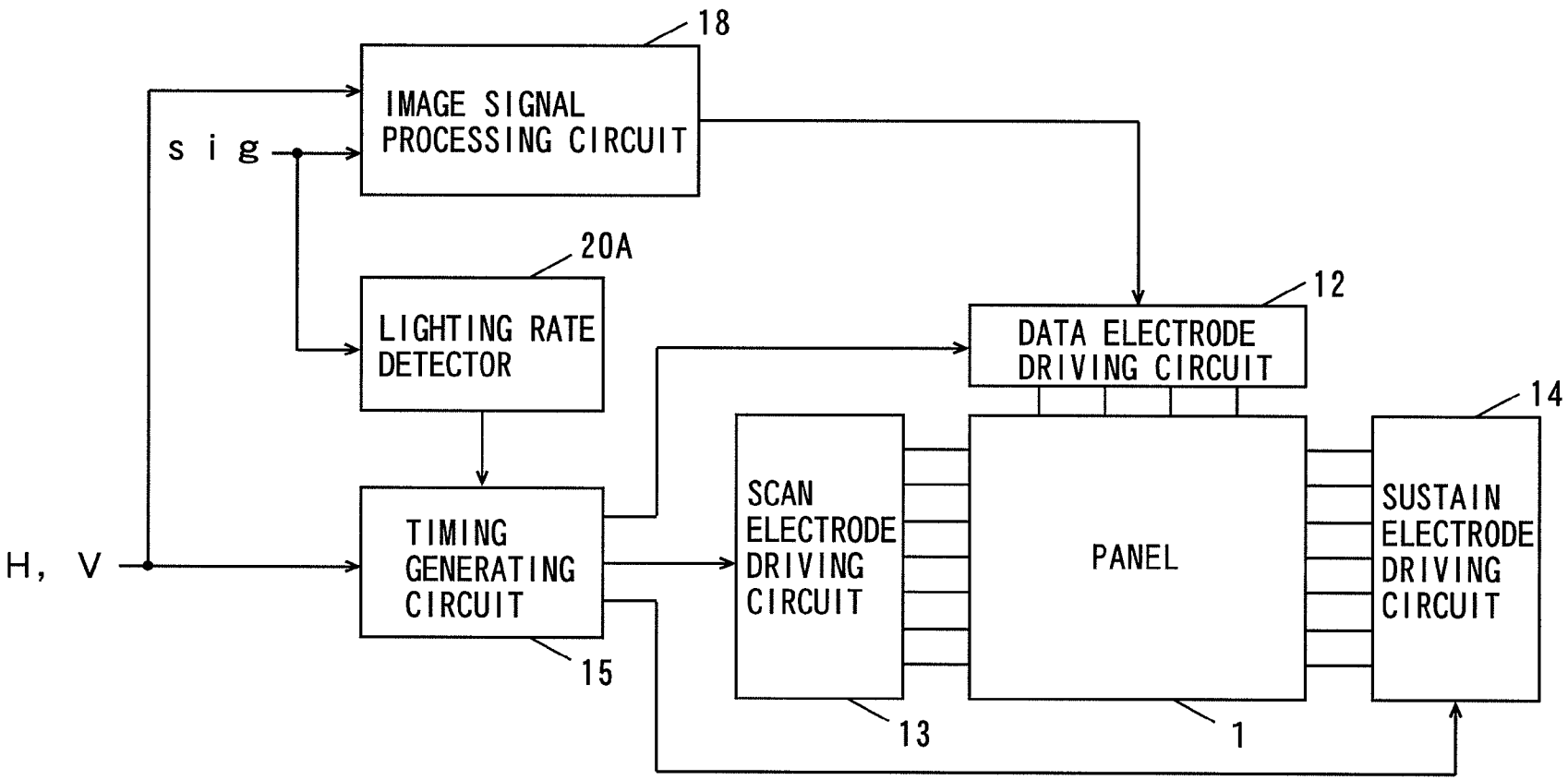
FIG. 3 is a configuration diagram of a plasma display device according to the first embodiment.

FIG. 3 is a configuration diagram of the plasma display device according to the first embodiment. This plasma display device includes the panel 1, a data electrode driving circuit 12, a scan electrode driving circuit 13, a sustain electrode driving circuit 14, a timing generating circuit 15, an image signal processing circuit 18, a lighting rate detector 20A and a power supply circuit (not shown).

The image signal processing circuit 18 converts an image signal sig into image data corresponding to the number of pixels of the panel 1, divides the image data on each pixel into a plurality of bits corresponding to a plurality of sub-fields, and outputs them to the data electrode driving circuit 12.

The data electrode driving circuit 12 converts the image data for each sub-field into signals corresponding to the data electrodes $D_1$ to $D_m$, respectively, and drives the data electrodes $D_1$ to $D_m$ based on the respective signals.

The timing generating circuit 15 generates timing signals based on a horizontal synchronizing signal H and a vertical synchronizing signal V, and supplies the timing signals to each of the driving circuit blocks (the data electrode driving circuit 12, the scan electrode driving circuit 13 and the sustain electrode driving circuit 14).

The scan electrode driving circuit 13 supplies a driving waveform to the scan electrodes $SC_1$ to $SC_n$ based on the timing signals, and the sustain electrode driving circuit 14 supplies a driving waveform to the sustain electrodes $SU_1$ to $SU_n$ based on the timing signals.

The lighting rate detector 20A detects the lighting rate of each sub-field, and supplies the values to the timing generating circuit 15. Here, the lighting rate is a value obtained by dividing the number of the discharge cells DC that simultaneously light up (emit light) by the number of all the discharge cells DC of the panel.

Next, description is made of driving voltage waveforms for driving the panel 1 and an operation of the panel 1.

In the present embodiment, each field is divided into a plurality of sub-fields each having a setup period, a write period and a sustain period. For example, one sub-field is divided into N sub-fields (hereinafter abbreviated as a first SF, a second SF, . . . and an Nth SF) on a time base.

Figure 4:
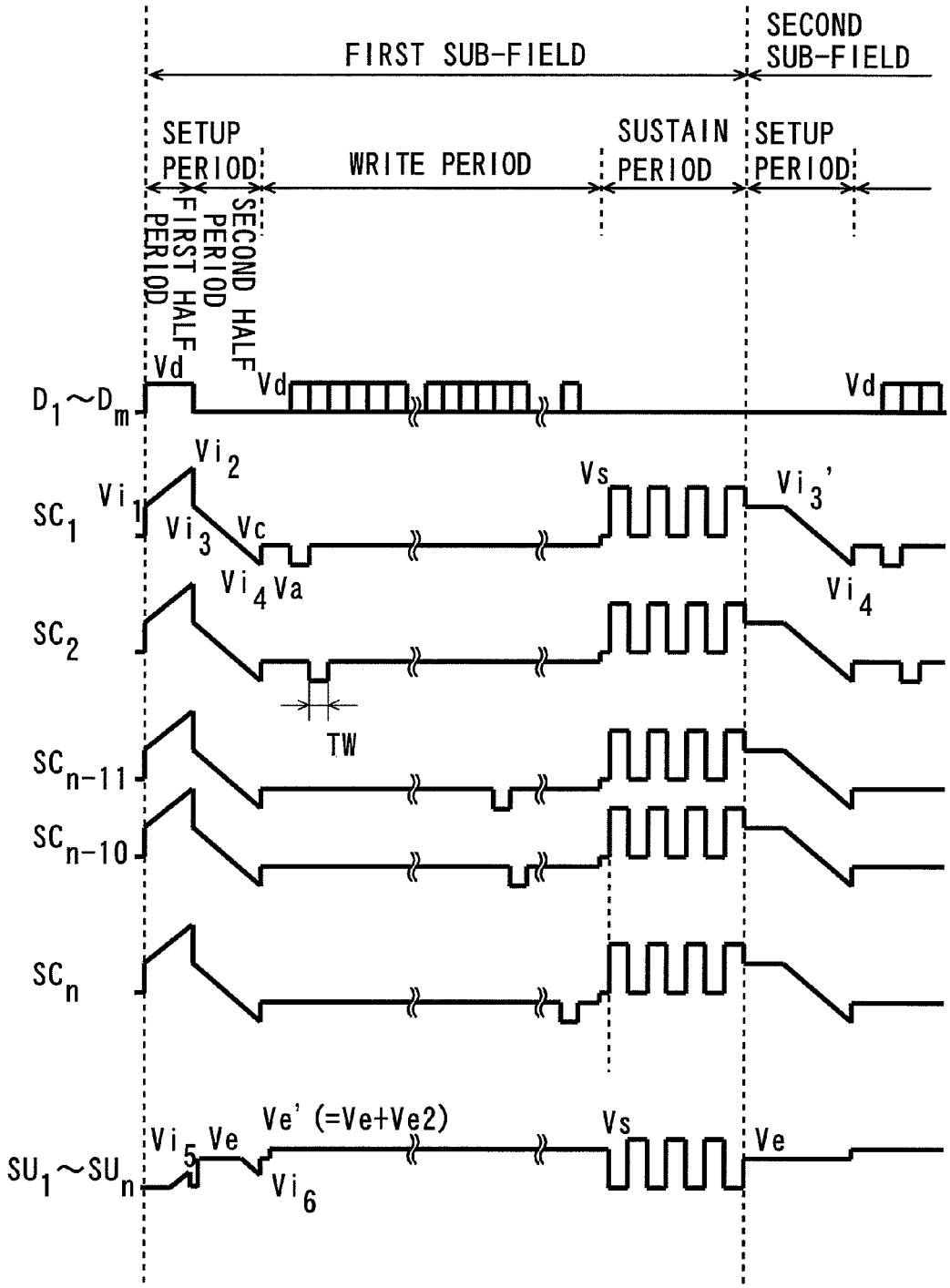
FIG. 4 is a chart showing driving voltage waveforms applied to the respective electrodes of the panel in the first embodiment.

FIG. 4 is a chart showing the driving voltage waveforms applied to the respective electrodes of the panel 1 in the first embodiment. In the example of FIG. 4, the driving voltage waveforms in the first SF and the second SF are shown.

In this example, the first SF corresponds to a sub-field having a setup period in which a setup operation for all cells is performed (hereinafter abbreviated as a "setup sub-field for all the cells"), and the second SF corresponds to a sub-field having a setup period in which a selective setup operation is performed (hereinafter abbreviated as a "selective setup sub-field").

First, the driving voltage waveforms in the first SF (the setup sub-field for all the cells) and the operation of the panel 1 based on the driving voltage waveforms are described.

In the first half (hereinafter referred to as a first half period) of the setup period of the first SF, the data electrodes $D_1$ to $D_m$ are held at a positive potential Vd, and the potential of the sustain electrodes $SU_1$ to $SU_n$ is held at 0 V. In the state, a ramp waveform gently rising from a potential $Vi_1$ that is not more than a discharge start voltage toward a potential $Vi_2$ that exceeds the discharge start voltage is applied to the scan electrodes $SC_1$ to $SC_n$.

Thus, first weak setup discharges are generated in all the discharge cells DC, and negative wall charges are stored on the scan electrodes $SC_1$ to $SC_n$ while positive wall charges are stored on the sustain electrodes $SU_1$ to $SU_n$ and the data electrodes $D_1$ to $D_m$. Here, a wall voltage on the electrode means a voltage generated by the wall charges stored on the dielectric layer, the phosphor layer or the like that covers the electrode.

At a predetermined timing in the first half period, a ramp waveform rising from 0 V to a potential $Vi_5$ is applied to the sustain electrodes $SU_1$ to $SU_n$ held at 0 V. This decreases a potential difference between the scan electrodes $SC_1$ to $SC_n$ and the sustain electrodes $SU_1$ to $SU_n$ by the voltage $Vi_5$. Thus, generation of strong discharges between the scan electrodes $SC_1$ to $SC_n$ and the sustain electrodes $SU_1$ to $SU_n$ is suppressed, improving the contrast.

In the second half of the setup period (hereinafter referred to as a second half period), a ramp waveform gently dropping from a potential $Vi_3$ toward a potential $Vi_4$ is applied to the scan electrodes $SC_1$ to $SC_n$ while the sustain electrodes $SU_1$ to $SU_n$ are held at a positive potential Ve. Then, second weak setup discharges are generated in all the discharge cells DC, causing the wall voltage on the scan electrodes $SC_1$ to $SC_n$ and the wall voltage on sustain electrodes $SU_1$ to $SU_n$ to be weakened and the wall voltage on the data electrodes $D_1$ to $D_m$ to be adjusted to a value suitable for a write operation.

At a predetermined timing in the above-mentioned second half period, a ramp waveform dropping from the positive potential Ve to a potential $Vi_6$ is applied to the sustain electrodes $SU_1$ to $SU_n$ held at the positive potential Ve. In this case, the wall charges stored in the first half period are reduced by the discharges in a period from a time point at which the potential difference between the sustain electrodes $SU_1$ to $SU_n$ and the scan electrodes $SC_1$ to $SC_n$ exceeds the discharge start voltage to a time point at which the ramp waveform is applied to the sustain electrodes $SU_1$ to $SU_n$.

As described above, the ramp waveform rising from 0 V to the potential $Vi_5$ is applied to the sustain electrodes $SU_1$ to $SU_n$ in the first half period in the present embodiment. In this case, as compared with those in a case where this ramp waveform is not applied, the wall charges stored in the sustain electrodes $SU_1$ to $SU_n$ are reduced by the voltage $Vi_5$ at the end of the first half period. Thus, it is concerned that the wall charges, which are required for the subsequent write operation, on the sustain electrodes $SU_1$ to $SU_n$ are insufficient in the second half period to destabilize write discharges.

Therefore, in the present embodiment, the ramp waveform dropping from the positive potential Ve to the potential $Vi_6$ is applied to the sustain electrodes $SU_1$ to $SU_n$ in the second half period as described above. The weak discharges are not generated in a period in which this ramp waveform is applied. Thus, a period in which the weak discharges are generated is shortened as compared with that in a case where the ramp waveform is not applied. This lowers the amount of reduction of the wall charges caused by the discharges. Accordingly, the wall charges on the sustain electrodes $SU_1$ to $SU_n$ are prevented from being less than the amount required for the write operation.

As a result, the wall voltage on the scan electrodes $SC_1$ to $SC_n$ and the wall voltage on the sustain electrodes $SU_1$ to $SU_n$ can be weakened to be values suitable for the write operation. Moreover, the wall voltage on data electrodes $D_1$ to $D_m$ is adjusted to a value suitable for the write operation.

Note that the wall voltage on the scan electrodes $SC_1$ to $SC_n$ and the wall voltage on the sustain electrodes $SU_1$ to $SU_n$ can be adjusted to voltages suitable for the subsequent write discharges by adjusting the value of the potential $Vi_6$.

In the subsequent write period, the sustain electrodes $SU_1$ to $SU_n$ are held at a positive potential Ve', and the scan electrodes $SC_1$ to $SC_n$ are temporarily held at a potential Vc. Next, a negative scan pulse voltage Va is applied to the scan electrode $SC_1$ on a first line while a positive write pulse voltage Vd is applied to a data electrode $D_k$ (k is any of 1 to m), among the data electrodes $D_1$ to $D_m$, of the discharge cell DC that should emit light on the first line.

In FIG. 4, a time in which the write pulse voltage Vd and the scan pulse voltage Va are simultaneously applied (hereinafter abbreviated as a "write time") is indicated by the arrow Tw.

In the write time Tw, the voltage at an intersection of the data electrode $D_k$ and the scan electrode $SC_1$ is a voltage obtained by adding the wall voltage on the data electrode $D_k$ and the wall voltage on the scan electrode $SC_1$ to an externally applied voltage (Vd-Va). Thus, the voltage at the intersection of the data electrode $D_k$ and the scan electrode $SC_1$ exceeds the discharge start voltage.

Then, the write discharges are generated between the data electrode $D_k$ and the scan electrode $SC_1$ and between the sustain electrode $SU_1$ and the scan electrode $SC_1$.

As a result, in this discharge cell DC, the positive wall charges are stored on the scan electrode $SC_1$, the negative wall charges are stored on the sustain electrode $SU_1$, and the negative wall charges are stored on the data electrode $D_k$. In this manner, the write discharge is generated in the discharge cell DC that should be displayed on the first line, so that the wall charges are stored on each of the electrodes $D_k$, $SC_1$, $SU_1$ (the write operation).

Meanwhile, the voltage at an intersection of a data electrode $D_h$ ($h \neq k$) to which the write pulse voltage Vd has not been applied and the scan electrode $SC_1$ does not exceed the discharge start voltage. Therefore, the write discharge is not generated in the discharge cell DC at the intersection. The foregoing write operation is sequentially performed in the discharge cells until the n-th line, and the write period is then finished.

In the subsequent sustain period, the scan electrodes $SC_1$ to $SC_n$ are returned to 0 V, and a sustain pulse voltage Vs is applied to the scan electrodes $SC_1$ to $SC_n$ for the first time in the sustain period. At this time, in the discharge cell DC in which the write discharge has been induced, a voltage between the scan electrode $SC_i$ and the sustain electrode $SU_i$ is a voltage obtained by adding the wall voltage on the scan electrode $SC_i$ and the wall voltage on the sustain electrode $SU_i$ to the sustain pulse voltage Vs, exceeding the discharge start voltage. Thus, a sustain discharge is induced between the scan electrode $SC_i$ and the sustain electrode $SU_i$, the negative wall charges are stored on the scan electrode $SC_i$, and the positive wall charges are stored on the sustain electrode $SU_i$.

At this time, the positive wall charges are stored also on the data electrode $D_k$. The sustain discharge is not generated in the discharge cell DC in which the write discharge has not been induced in the write period, and the wall voltage is held in a state at the end of the setup period.

Next, the scan electrodes $SC_1$ to $SC_n$ are returned to 0 V, and a second sustain pulse voltage Vs is applied to the scan electrodes $SC_1$ to $SC_n$. Then, the voltage between the sustain electrode $SU_i$ and the scan electrode $SC_i$ exceeds the discharge start voltage in the discharge cell DC in which the sustain discharge has been induced. Accordingly, the sustain discharge is again induced between the sustain electrode $SU_i$ and the scan electrode $SC_i$, the negative wall charges are stored on the sustain electrode $SU_i$, and the positive wall charges are stored on the scan electrode $SC_i$.

Similarly to this, the sustain pulses with the number corresponding to luminance weights are alternately applied to the scan electrodes $SC_1$ to $SC_n$ and the sustain electrodes $SU_1$ to $SU_N$, so that the sustain discharges are continuously performed in the discharge cells DC in which the write discharges have been induced in the write period. In this way, a sustain operation is finished in the sustain period.

Next, the driving voltage waveforms in the second SF (the selective setup sub-field) and the operation of the panel 1 based on the driving voltage waveforms are described.

In the setup period of the second SF, first, the sustain electrodes $SU_1$ to $SU_n$ are held at the positive potential Ve, and the data electrodes $D_1$ to $D_m$ are held at the ground potential. In this state, the ramp waveform gently dropping from a potential $Vi_a'$ toward the potential $Vi_4$ is applied to the scan electrodes $SC_1$ to $SC_n$. Then, weak setup discharges are generated in the discharge cells DC in which the sustain discharges have been induced in the sustain period of the preceding sub-field. Thus, the wall voltage on the scan electrode $SC_i$ and the wall voltage on the sustain electrode $SU_i$ are weakened, and the wall voltage on the data electrode $D_k$ is adjusted to a value suitable for the write operation.

Meanwhile, in the discharge cell DC in which the write discharge and the sustain discharge have not been induced in the preceding sub-field, the discharge is not generated, and the wall charges are held constant in a state at the end of the setup period of the preceding sub-field.

As described above, the selective setup operation for selectively generating the setup discharges in the discharge cells DC in which the sustain discharges have been induced in the immediately preceding sub-field is performed in the setup period of the second SF, that is, the selective setup sub-field.

Since the driving voltage waveforms and the operations in the write period and the sustain period are the same as the driving voltage waveforms and the operations in the write period and the sustain period in the first SF (the setup sub-field for all the cells), explanation is omitted.

Next, a reason why the ramp waveform is applied to the sustain electrodes $SU_1$ to $SU_n$ in the setup period of the first SF is described in comparison with a conventional driving method.

Figure 5:
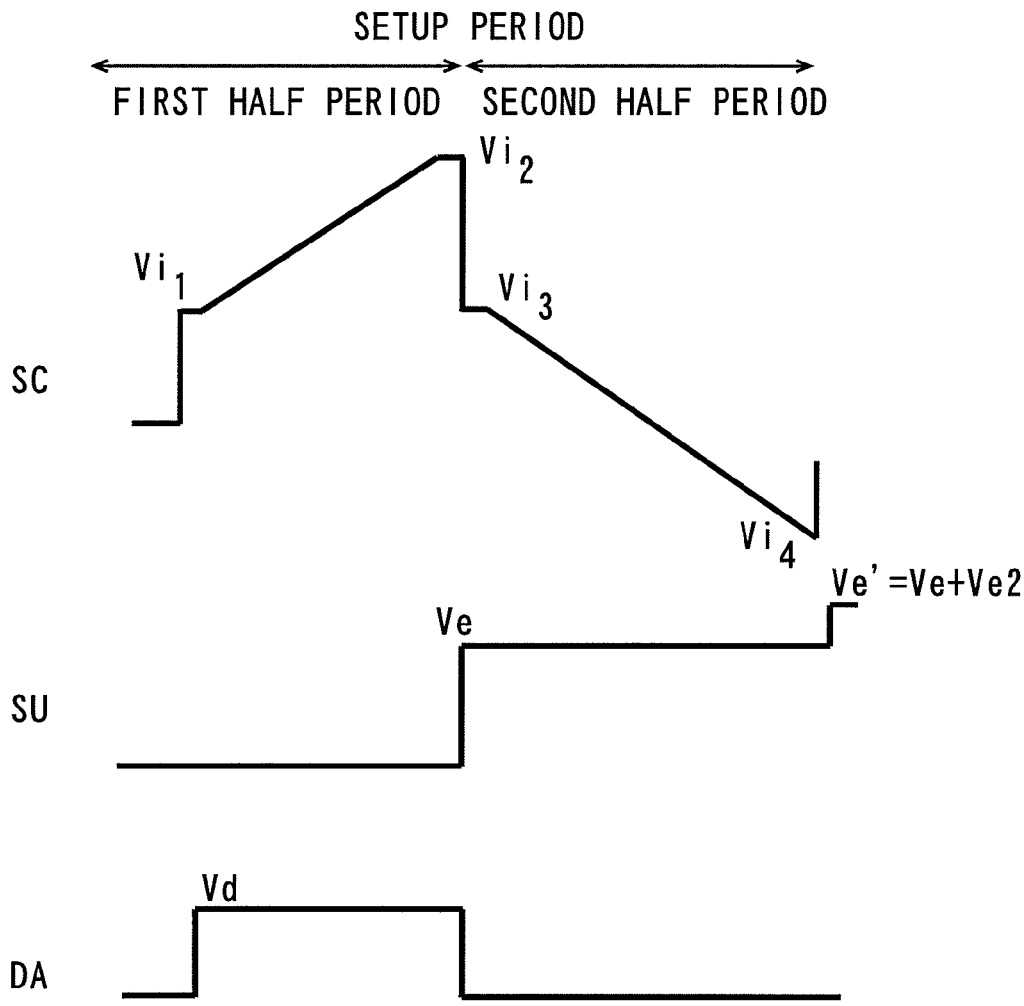
FIG. 5 is a chart showing driving voltage waveforms used in a setup operation for all cells in a conventional plasma display device.
Figure 6:
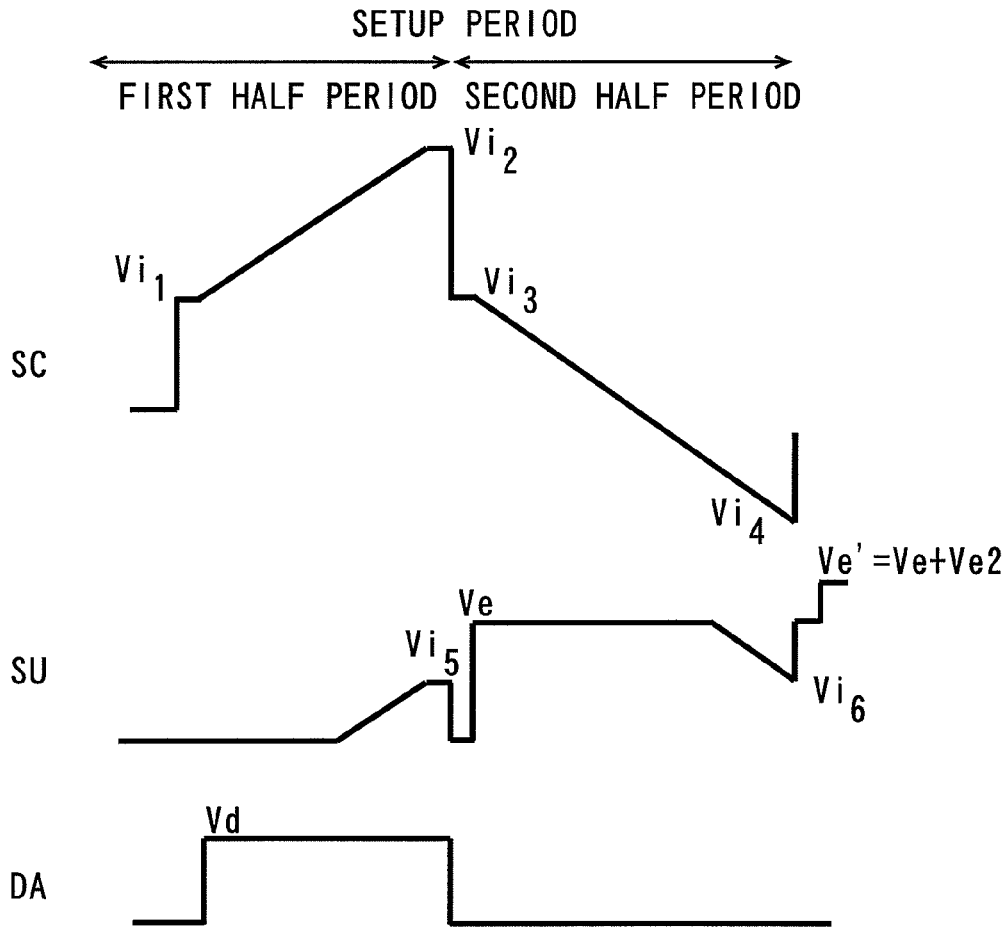
FIG. 6 is a chart showing driving voltage waveforms used in a setup operation for all cells in the plasma display device according to the first embodiment.

FIG. 5 is a chart showing driving voltage waveforms used in a conventional plasma display device in the setup operation for all the cells. FIG. 6 is a chart showing driving voltage waveforms used in the plasma display device according to the first embodiment in the setup operation for all the cells. In FIGS. 5 and 6, the scan electrodes $SC_1$ to $SC_n$, the sustain electrodes $SU_1$ to $SU_n$ and the data electrodes $D_1$ to $D_m$ are represented by characters SC, SU and DA, respectively.

First, the driving voltage waveforms of FIG. 5 in the first half period are described. In the first half period of FIG. 5, the ramp waveform gently rising from the positive potential $Vi_1$ to the positive potential $Vi_2$ is applied to the scan electrodes SC. At this time, the sustain electrodes SU are held at 0 V, and the data electrodes are held at the potential Vd.

Therefore, the wall charges corresponding to the discharges are stored in the sustain electrodes SU in a period in which the voltage between the scan electrodes SC and the sustain electrodes SU varies from the discharge start voltage to the voltage $Vi_2$.

In addition, the wall charges corresponding to the discharges are stored in the data electrodes DA in a period in which the voltage between the scan electrodes SC and the data electrodes DA varies from the discharge start voltage to the voltage ($Vi_2$-Vd).

Note that data pulses Vd are applied to the data electrodes DA in the first half period. Thus, the discharges between the scan electrodes SC and the sustain electrodes SU are generated before the discharges between the scan electrodes SC and the data electrodes DA. This stabilizes the setup discharges.

In this case, in the first half period, the peak value of the rising ramp waveform applied to the scan electrodes SC is required to be adjusted so that a potential difference between the scan electrodes SC and the data electrodes DA sufficiently exceeds the discharge start voltage. As described above, the peak value of the ramp waveform is adjusted, so that the sufficient wall charges are stored on the scan electrodes SC and the data electrodes DA.

Meanwhile, since the sustain electrodes SU are held at 0 V (the ground potential) in the first half period, setting a high peak value of the rising ramp waveform leads a larger potential difference between the scan electrodes SC and the sustain electrodes SU. In this case, the strong discharges are induced to decrease the contrast.

Then, as shown in FIG. 6, a period in which the sustain electrodes SU are separated from a ground terminal and a node to be in a high impedance state is provided within a period, in which the rising ramp waveform is applied to the scan electrodes SC, of the first half period in the driving method of the plasma display device according to the present embodiment.

In the present embodiment, the high impedance state means a state where the sustain electrodes SU are separated from a power supply terminal, the ground terminal and the node (a floating state).

In this case, the potential of the sustain electrodes SU varies according to the variation of the potential of the scan electrodes SC by capacitive coupling. Accordingly, the ramp waveform is applied also to the sustain electrodes SU. This allows the discharges between the scan electrodes SC and the sustain electrodes SU to be reduced and the contrast to be improved.

Next, the driving voltage waveforms of FIG. 5 in the second half period are described. The second half period in the setup period is set in order to adjust the respective charges stored in the electrodes SC, SU and DA in the first half period.

In FIG. 5, in the sustain electrodes SU, the wall voltage is weakened depending on magnitude of the voltage from the discharge start voltage to a potential difference between the potential $Vi_2$ and the potential Ve. Moreover, in the data electrodes DA, the wall voltage is weakened depending on magnitude of the voltage from the discharge start voltage to the potential $Vi_2$.

Here, the potential Ve of the sustain electrodes SU in the second half period is set in order to stabilize the write operation in the write period following the setup period. Thus, it is difficult to vary the potential of the sustain electrodes SU. Therefore, conventionally, the potential $Vi_4$ has been set based on either the sustain electrodes SU or the data electrodes DA, similarly to the first half period shown in FIG. 5.

Therefore, as described above, when the rising ramp waveform is applied to the sustain electrodes SU to reduce the discharges between the scan electrodes SC and the sustain electrodes SU in the first half period, the wall charges stored in the sustain electrodes SU are reduced to destabilize the write discharges in the subsequent write period.

Then, in the present embodiment, the ramp waveform is applied to the sustain electrodes SU in not only the first half period but also the second half period of the setup period. As described above, the potential $Vi_5$ of the rising ramp waveform and the potential $Vi_6$ of the dropping ramp waveform are set, so that the voltage applied to the sustain electrodes SU varies when the ramp waveform is applied to the scan electrodes SC. Accordingly, the potential difference between the scan electrodes SC and the sustain electrodes SU, and the potential difference between the scan electrodes SC and the data electrodes DA are independently controlled in the first half period and the second half period.

Specifically, the potential of the sustain electrodes SU is held at 0 V (GND: the ground potential) for a predetermined period since application of the rising ramp waveform that rises the potential of the scan electrodes SC from the positive potential $Vi_1$ to the positive potential $Vi_2$ is started. Thereafter, the ramp waveform is applied also to the sustain electrodes SU from a timing at which the potential of the scan electrodes SC reaches a predetermined height by the rising ramp waveform. Then, the discharges and the storage of charges between the scan electrodes SC and the sustain electrodes SU stop at the timing at which the ramp waveform is applied to the sustain electrodes SU.

Next, after the application of the rising ramp waveform to the scan electrodes SC is finished, that is, after the scan electrodes SC reach the positive potential $Vi_2$, the sustain electrodes SU are temporarily grounded at a timing at which the potential of the scan electrodes SC is switched from the positive potential $Vi_2$ to the positive potential $Vi_3$, and the voltage Ve is subsequently applied to the sustain electrodes SU before the dropping ramp waveform is applied to the scan electrodes SC.

Then, the sustain electrodes SU are held at the potential Ve for a predetermined period since application of the dropping ramp waveform that drops the potential of the scan electrodes SC from the positive potential $Vi_3$ to the negative potential $Vi_4$ was started. The ramp waveform is applied also to the sustain electrodes SU from a timing at which a predetermined period has elapsed. Accordingly, the discharges and the adjustment of the charges between the scan electrodes SC and the sustain electrodes SU stop at the timing at which the ramp waveform is applied to the sustain electrodes SU.

After this, the application of the ramp waveform to the sustain electrodes SU is finished at the timing at which the application of the dropping ramp waveform to the scan electrodes SC is finished. Then, the sustain electrodes SU are held at the potential Ve. Moreover, the sustain electrodes SU are held at the potential Ve' in the subsequent write period.

As described above, in the first half period, the ramp waveform is applied to the sustain electrodes SU and the potential $Vi_5$ of the ramp waveform is set, so that the discharges between the scan electrodes SC and the sustain electrodes SU are reduced. Moreover, even when the wall charges stored in the sustain electrodes SU are reduced, the ramp waveform is applied to the sustain electrodes SU and the potential $Vi_6$ of the ramp waveform is set in the subsequent second half period of the setup period, so that the setup operation can be completed without unnecessarily eliminating the wall charges stored in the scan electrodes SC and the sustain electrodes SU.

In this manner, since unnecessary discharges are suppressed, the write discharges in the subsequent write period can be stabilized while light emission that is not involved in display can be suppressed and images having a high contrast can be obtained.

In the present embodiment, it is desirable that set values of the predetermined potentials $Vi_1$ to $Vi_6$ are optimally set depending on the discharge cells DC.

The sustain electrodes SU are brought into the high impedance state at predetermined timings in the first half period and the second half period, for example. In this case, the voltage for setting the sustain electrodes SU at the potential $Vi_5$ and the potential $Vi_6$ can be easily obtained without raising cost of a circuit.

While the sustain electrodes SU are grounded to 0 V at the timing at which the potential of the scan electrodes SC is switched from the potential $Vi_2$ to the potential $Vi_3$, and the sustain electrodes SU are then held at the potential Ve before the application of the dropping ramp waveform to the scan electrodes SC in FIG. 6, this is one example. The potential of the sustain electrodes SU at the potential $Vi_5$ may be held at the potential Ve.

It is desirable that an application start timing of the rising ramp waveform to the sustain electrodes SU is set to a timing after the discharges between the scan electrodes SC and the sustain electrodes SU are started in all the discharge cells DC. In addition, it is desirable that an application start timing of the dropping ramp waveform to the sustain electrodes SU is optimally set depending on the panel 1 so that the potential difference between the scan electrodes SC and the sustain electrodes SU is adjusted.

In the present embodiment, the potential of the sustain electrodes SU is increased from the potential Ve to the potential Ve' by adding the voltage Ve2 in the write period in order to stabilize the discharges. Even when the voltage Ve2 is not added, however, the effects are the same.

In the present embodiment, the peak value of the ramp waveform applied to the sustain electrodes SU is controlled by the lighting rate of each sub-field. The reason will be described.

In the present embodiment, an image of which lighting rate in each sub-field is lower than a predetermined threshold value is detected as a "high contrast image". Examples of such a high contrast image include an image of the night sky with the moon and stars, an image having a white character displayed with a dark screen as a background, and so on.

In such a image, an object of a high luminance exists in a background of a low luminance. That is, such an image includes a display region having a low luminance and a large area and a display region having a high luminance and a small area. Therefore, improving the contrast allows such an image to be displayed on the panel 1 with remarkable clarity.

In such an image, a display region of black is large while a discharge area is small in the panel 1. Accordingly, a stable write operation can be performed even when the amount of the setup discharges is decreased. Moreover, the peak value of the ramp waveform applied to the sustain electrodes SU in the setup period can be increased. Thus, a significant improvement effect of the contrast can be obtained by lowering a luminance level of black.

It is desired that the peak values of the rising and dropping ramp waveform applied to the sustain electrodes SU are gradually changed when the lighting rate of each sub-field falls below or exceeds a predetermined threshold value so that variations in light emission luminance in the setup period are not visually recognized. This gradual change is preferably performed so that variations in the light emission luminance in the setup period are not visually recognized, and can be performed using a hysteresis function, for example.

Figure 7:
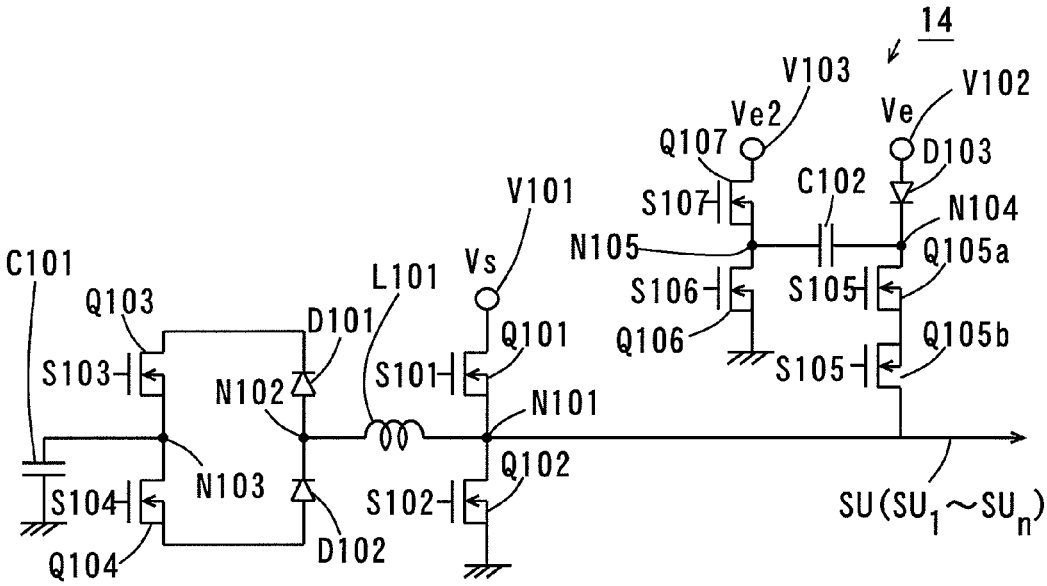
FIG. 7 is a circuit diagram showing an example of the configuration of a sustain electrode driving circuit of FIG. 3.

FIG. 7 is a circuit diagram showing an example of the configuration of the sustain electrode driving circuit 14 of FIG. 3. The sustain electrode driving circuit 14 of FIG. 7 is a charge-recovery type sustain electrode driving circuit.

As shown in FIG. 7, the sustain electrode driving circuit 14 includes diodes D101 to D103, a capacitor C101, a capacitor C102, n-channel field-effect transistors (hereinafter abbreviated as transistors) Q101, Q102, Q103, Q104, Q105*a*, Q105*b*, Q106, Q107 and a coil L101.

The transistor Q101 is connected between a power supply terminal V101 that receives the voltage Vs and a node N101, and a control signal 5101 is supplied to a gate.

The transistor Q102 is connected between the node N101 and a ground terminal, and a control signal S102 is supplied to a gate. The node N101 is connected to the sustain electrodes SU (the sustain electrodes $SU_1$ to $SU_n$ of FIG. 2).

The coil L101 is connected between the node N101 and a node N102. Between the node N102 and a node N103, the diode D102 and the transistor Q104 are connected in series while the diode D101 and the transistor Q103 are connected in series. The capacitor C101 is connected between the node N103 and a ground terminal. A control signal S103 is supplied to a gate of the transistor Q103 and a control signal S104 is supplied to a gate of the transistor Q104.

The diode D103 is connected between a power supply terminal V102 that receives the voltage Ve and a node N104. The transistor Q105*a* and the transistor Q105*b* are connected in series between the node N104 and the node N101. Control signals S105 are supplied to respective gates of the transistor Q105*a* and the transistor Q105*b*. The capacitor C102 is connected between the node N104 and a node N105.

The transistor Q106 is connected between the node N105 and a ground terminal, and a control signal 5106 is supplied to a gate. The transistor Q107 is connected between a power supply terminal V103 that receives the voltage Ve2 and the node N105, and a control signal S107 is supplied to a gate.

While the n-channel FETs are used as switching devices in FIG. 7, other devices such as an IGBT (insulated gate bipolar transistor) may be alternatively used as a device that performs a switching operation.

The control signals S101 to S107 supplied to the n-channel FETs Q101 to Q107 are supplied from the timing generating circuit 15 of FIG. 3 to the sustain electrode driving circuit 14 as timing signals. These control signals S101 to S107 control the charges to be given and received between the recovery capacitor C101 and the sustain electrodes (not shown).

Figure 8:
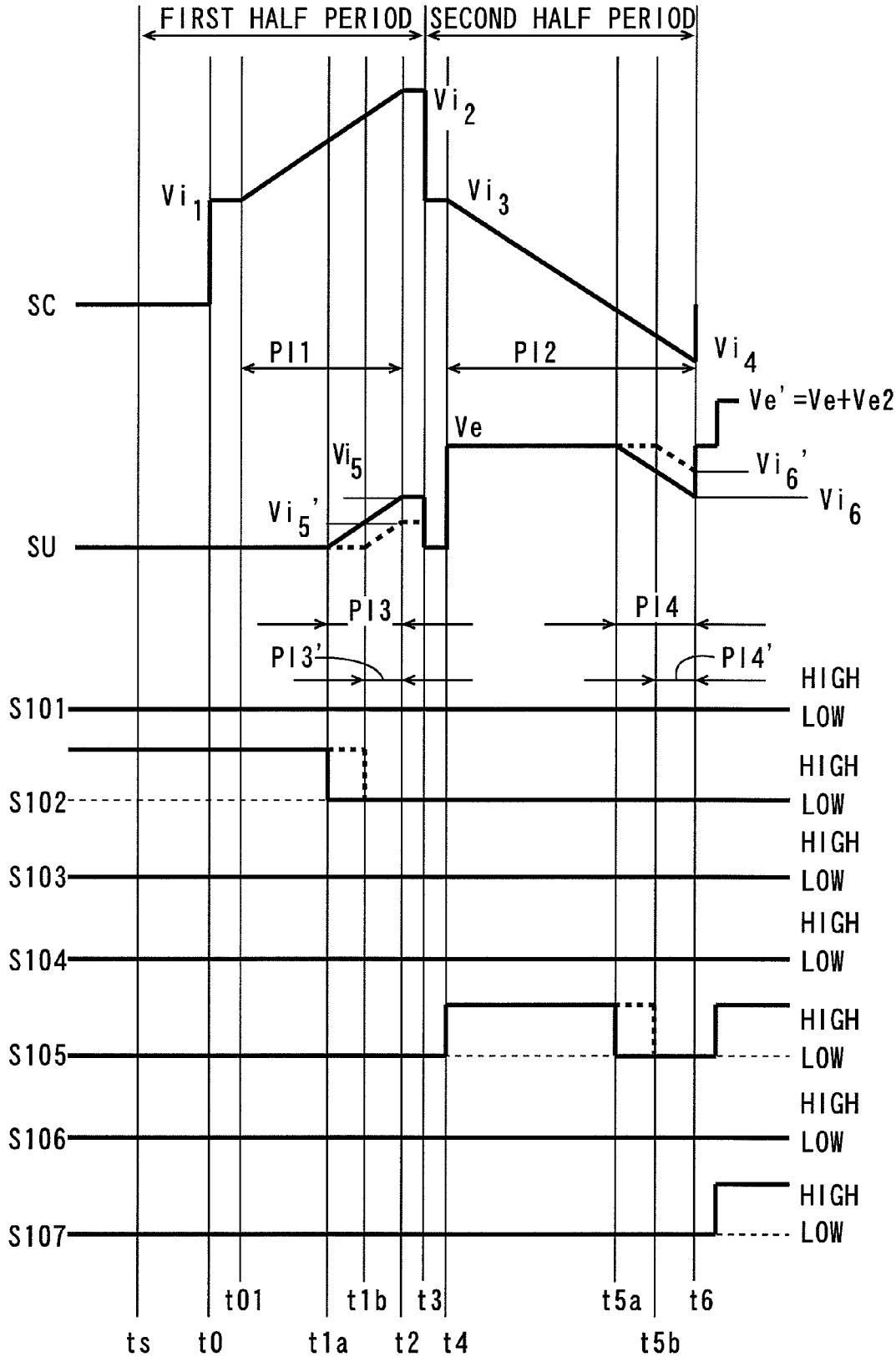
FIG. 8 is a chart showing driving voltage waveforms supplied to the scan electrodes and the sustain electrodes and timings of control signals supplied to the sustain electrode driving circuit in the setup period of the first SF of FIG. 4 in the plasma display device according to the first embodiment.

FIG. 8 is a chart showing the driving voltage waveforms supplied to the scan electrodes SC and the sustain electrodes SU and timings of the control signals supplied to the sustain electrode driving circuit 14 in the setup period of the first SF of FIG. 4 in the plasma display device according to the first embodiment.

In FIG. 8, the driving voltage waveform of the scan electrodes SC is shown in the uppermost stage and the driving voltage waveform of the sustain electrodes SU is shown in the next stage.

In the present embodiment, the control signals S102, S105 applied to the sustain electrodes SU vary depending on the lighting rate of each sub-field. Specifically, the control signals S102, S105 are different in respective cases where the lighting rate of the sub-field is lower than the predetermined threshold value and where the lighting rate of the sub-field is not less than the predetermined threshold value.

First, description is made of a case where the lighting rate of the sub-field is lower than the predetermined threshold value. At a starting point is of the first SF, the control signals S101, S103, S104, S105, S106 and S107 are at respective low levels, and the control signal S102 is at a high level. Therefore, the transistor Q101, Q103, Q104, Q105*a*, Q105*b*, Q106 and Q107 are turned off and the transistor Q102 is turned on. Thus, the sustain electrodes SU (the node N 101 of FIG.7) are at the ground potential.

After this, the potential of the scan electrodes SC rises to $Vi_1$ at a time point t0. Then, the rising ramp waveform rising from the potential $Vi_1$ to the potential $Vi_2$ is applied to the scan electrodes SC at a time point t01. This ramp waveform is applied to the scan electrodes SC in a first period PI1 from the time point t01 to a time point t2.

After a predetermined period has elapsed since the application of the rising ramp waveform to the scan electrodes SC was started, the control signal S102 attains a low level at a time point t1*a*. Thus, the transistor Q102 is turned off. In this case, the sustain electrodes SU are connected to neither the power supply terminal nor the ground terminal. As a result, the sustain electrodes SU are brought into the high impedance state. Accordingly, in a third period PI3 from the time point t1*a* to the time point t2, the potential of the sustain electrodes SU rises to $Vi_5$ with the rise of the potential of the scan electrodes SC.

When the sustain electrodes SU are in the high impedance state, the potential difference between the scan electrodes SC and the sustain electrodes SU are held substantially constant. Therefore, the discharges are unlikely to be generated between the scan electrodes SC and the sustain electrodes SU. In a period from the time point t2 to a time point t3, since the potential of the scan electrodes SC is maintained constant, the potential of the sustain electrodes SU is also maintained constant.

At a time point t4, application of the dropping ramp waveform dropping from the potential $Vi_3$ to the potential $Vi_4$ to the scan electrodes SC is started. This ramp waveform is applied to the scan electrodes SC in a second period PI2 from the time point t4 to a time point t6.

At this time, the control signal S105 attains a high level. Thus, the transistors Q105*a*, Q105*b* are turned on. This causes a current to flow from the power supply terminal V102 to the sustain electrodes SU through the node N104. As a result, the potential of the sustain electrodes SU rises to be held at the potential Ve.

After a predetermined period has elapsed since the application of the dropping ramp waveform to the scan electrodes SC was started, the control signal S105 attains the low level at a time point t5*a*. Thus, the transistors Q105*a*, Q105*b* are turned off. In this case, the sustain electrodes SU are connected to neither the power supply terminal nor the ground terminal. As a result, the sustain electrodes SU are again brought into the high impedance state. Accordingly, in a fourth period PI4 from the time point t5*a* to the time point t6, the potential of the sustain electrodes SU drops to $Vi_6$ with the drop of the potential of the scan electrodes SC. When the sustain electrodes SU are in the high impedance state, the potential difference between the scan electrodes SC and the sustain electrodes SU are held substantially constant. Therefore, the discharges are unlikely to be generated between the scan electrodes SC and the sustain electrodes SU.

Thereafter, the control signals S105, S107 attain the high levels. Thus, the sustain electrodes SU are held at the potential Ve' obtained by adding the voltage Ve2 to the potential Ve.

Next, description is made of a case where the lighting rate of the sub-field is not less than the predetermined threshold value. When the lighting rate of the sub-field is not less than the predetermined threshold value, the control signal S102 attains the low level at a time point t1*b* (see the bold dotted line) after a predetermined period has elapsed since the application of the rising ramp waveform to the scan electrodes SU was started. Thus, the transistor Q102 is turned off. In this case, the sustain electrodes SU are brought into the high impedance state as described above. This causes the potential of the sustain electrodes SU to rise to $Vi_5'$ with the rise of the potential of the scan electrodes SC.

Here, the time point t1*b* is set so as to be later than the time point t1*a* at which the control signal S102 is switched from the high level to the low level when the lighting rate of the sub-field is lower than the predetermined threshold value. Therefore, when the lighting rate of the sub-field is not less than the predetermined threshold value, a period in which the sustain electrodes SU are in the high impedance state is shortened (see a third period indicated by the arrow PI3'), as compared with the case where the lighting rate of the sub-field is lower than the predetermined threshold value. As a result, the peak value (a potential difference between the ground potential and the potential $Vi_5'$) of the rising ramp waveform applied to the sustain electrodes SU becomes smaller than the peak value (a potential difference between the ground potential and the potential $Vi_5$) when the lighting rate of the sub-field is lower than the predetermined threshold value.

In addition, after a predetermined period has elapsed since the application of the dropping ramp waveform to the scan electrodes SC was started, the control signal S105 attains the low level at a time point t5*b* (see the bold dotted line). Thus, the transistors Q105*a* , Q105*b* are turned off. In this case, the sustain electrodes SU are brought into the high impedance state as described above. Thus, the potential of the sustain electrodes SU drops to $Vi_6'$ with the drop of the potential of the scan electrodes SC.

Here, the time point t5*b* is set so as to be later than the time point t5*a* at which the control signal S102 is switched form the high level to the low level when the lighting rate of the sub-field is lower than the predetermined threshold value. Therefore, when the lighting rate of the sub-field is not less than the predetermined threshold value, the period in which the sustain electrodes SU are in the high impedance state is shortened (see a fourth period indicated by the arrow PI4'), as compared with the case where the lighting rate of the sub-field is lower than the predetermined threshold value. As a result, the peak value (a potential difference between the potential Ve and the potential $Vi_6'$) of the dropping ramp waveform applied to the sustain electrodes SU becomes smaller than the peak value (a potential difference between the potential Ve and the potential $Vi_6$) when the lighting rate of the sub-field is lower than the predetermined threshold value.

As described above, the periods (the third period and the fourth period) in which the sustain electrodes SU are in the high impedance state are set longer when the lighting rate of the sub-field is lower than the predetermined threshold value, and the periods in which the sustain electrodes SU are in the high impedance state are set shorter when the lighting rate of the sub-field is not less than the predetermined threshold value in the plasma display device according to the present embodiment.

This causes the peak values of the ramp waveform generated in the sustain electrodes SU when the lighting rate of the sub-field is lower than the predetermined threshold value to be larger than the peak values of the ramp waveform generated when the lighting rate of the sub-field is not less than the predetermined threshold value.

Accordingly, the following effects can be obtained. When the lighting rate of the sub-field is lower than the predetermined threshold value, an image displayed in the sub-field has a large display region of black. Thus, a discharge area on the panel 1 is decreased. Therefore, even when the periods in which the sustain electrodes SU are in the high impedance state are set longer and the amount of adjustment of charges in the setup discharges is decreased, the write operation is stably performed in the subsequent write period. Thus, when the lighting rate is low, the application timings of the ramp waveform voltage applied to the sustain electrodes SU are advanced to increase the peak values of the ramp waveform voltage. As a result, generation of the setup discharges is decreased, allowing a clear image with a high contrast to be obtained.

Meanwhile, when the lighting rate of the sub-field is not less than the predetermined threshold value, the periods in which the sustain electrodes SU are in the high impedance state are set shorter and the amount of adjustment of the charges in the setup discharge is increased. This causes the write operation to be stably performed in the subsequent write period. Thus, when the lighting rate is high, the application timings of the ramp waveform voltage applied to the sustain electrodes SU are set so as to be late to decrease the peak values of the ramp waveform voltage. As a result, the wall charges necessary for the subsequent write operation are sufficiently adjusted while generation of the setup discharges in the setup period is decreased.

FIG. 9 is a table showing an example of a relationship between the lighting rates of the sub-field and the application timings of the ramp waveform to the sustain electrodes SU. In description of FIG. 9, the peak value of the ramp waveform means a voltage value at the end of the application of the ramp waveform gently rising or dropping with time.

In this example, the peak values of the ramp waveform of the sustain electrodes SU is set in two levels depending on the lighting rate of the sub-field. In this example, the threshold value of the lighting rate explained in FIG. 8 is set to 5%.

As shown in FIG. 9, when the lighting rate is not less than 5%, the peak value of the rising ramp waveform applied to the sustain electrodes SU is set at 70 V, for example, and the peak value of the dropping ramp waveform is set at 90 V, for example. The timing at which the sustain electrodes SU are brought into the high impedance state in order to obtain the rising ramp waveform is set at 70 μs, for example. The timing at which the sustain electrodes SU are brought into the high impedance state in order to obtain the dropping ramp waveform is set at 140 μs, for example.

Meanwhile, when the lighting rate is lower than 5%, the peak value of the rising ramp waveform applied to the sustain electrodes SU is set at 35 V, for example, and the peak value of the dropping ramp waveform is set at 125 V, for example. The timing at which the sustain electrodes SU are brought into the high impedance state in order to obtain the rising ramp waveform is set at 100 μs, for example. The timing at which the sustain electrodes SU are brought into the high impedance state in order to obtain the dropping ramp waveform is set at 170 μs, for example.

Although the timings and the peak values in FIG. 9 are shown as examples in the present embodiment, it is preferable that these values are suitably set depending on the discharge start voltage between the scan electrodes SC and the sustain electrodes SU in the panel.

In this example, when the lighting rate of each sub-field varies from a rate not less than 5% to a rate lower than 5%, a drive condition of the panel 1 is changed depending on the timings and the peak values of the ramp waveform shown in FIG. 9.

When the drive condition of the panel 1 is significantly changed as described above, variations in the light emission luminance in the setup period may be visually recognized. Therefore, the drive condition may be gradually changed so that the variations in the luminance are not visually recognized.

For example, when the lighting rate of each sub-field varies from the rate not less than 5% to the rate lower than 5%, the timing at which the sustain electrodes SU are brought into the high impedance state is shifted by 2 μs in each of the subsequent fields, so that the timing is changed to the desired timing shown in FIG. 9. In this manner, the timing is gradually shifted in each field, so that the timing at which the sustain electrodes SU are brought into the high impedance state is changed so as to come close to the desired timing by degrees. This sufficiently prevents the variations in the luminance from being visually recognized.

Similarly to the foregoing, also when the lighting rate of the sub-field varies from the rate lower than 5% to the rate not less than 5%, the timing at which the sustain electrodes SU are brought into the high impedance state is shifted by 2 μs in each of the subsequent fields, so that the timing is changed to the desired timing shown in FIG. 9. In this manner, the timing is gradually shifted in each field, so that the timing at which the sustain electrodes SU are brought into the high impedance state is changed so as to come close to the desired timing by degrees. This sufficiently prevents the variations in the luminance from being visually recognized.

A hysteresis width may be set in the threshold value. For example, the hysteresis widths of 2% are set over and under the threshold value of 5%, respectively. The drive condition of the panel 1 can be changed as follows by setting the hysteresis width.

For example, when the lighting rate of the sub-field varies from the rate not less than 5% to the rate lower than 5%, the drive condition of the panel 1 is changed depending on the timings and the peak values of the ramp waveform shown in FIG. 9; however, when the lighting rate of the sub-field subsequently rises, the drive condition of the panel 1 is not changed until the lighting rate attains at least 7%.

Such a hysteresis control prevents the luminance of the image from being significantly changed when the lighting rate of the sub-field of the image to be displayed is about 5%, for example. This sufficiently prevents the variations in the light emission luminance in the setup period from being visually recognized.

While the present embodiment describes the panel 1 driven using the threshold value shown in FIG. 9, it is desirable that this threshold value is optimally set depending on the discharge start voltage of the panel 1. In addition, while description is made of setting one threshold value in the present embodiment, a plurality of threshold values may be set.

While description is made of the example where the setup sub-field for all the cells is set to the first SF in the present embodiment, the setup sub-field for all the cells may be set to a sub-field other than the first SF (the second SF, the third SF or another SF, for example) or may be set to a plurality of sub-fields.

In this case, in the sub-field into which the setup waveform for all the cells is inserted, the ramp waveform is applied to the sustain electrodes SU in a period in which the ramp waveform is being applied to the scan electrodes SC. In this manner, effects that are the same as the foregoing can be obtained in the sub-field into which the setup waveform for all the cells is inserted.

When the setup waveforms for all the cells are inserted into the plurality of sub-fields, the ramp waveform may be applied to the sustain electrodes SU in the period in which the ramp waveform is being applied to the scan electrodes SC selectively in specific sub-fields.

In the present embodiment, the sustain electrodes SU are brought into the high impedance state, so that the ramp waveform of the sustain electrodes SU is obtained. The embodiment is not limited to this, and the same configuration as a ramp waveform generating circuit for the scan electrodes SC may be provided in the plasma display device as a ramp waveform generating circuit for the sustain electrodes SU. In this case, the ramp waveform having the same slope as the ramp waveform supplied to the scan electrodes SC can be easily supplied to the sustain electrodes SU in the setup period.

When display is performed on the panel 1 with the stable setup discharges, the data pulses Vd may not be applied to the data electrodes DA in the first half period of the setup period.

Second Embodiment

Hereinafter, a plasma display device according to a second embodiment is described by referring to differences from the plasma display device according to the first embodiment.

Figure 10:
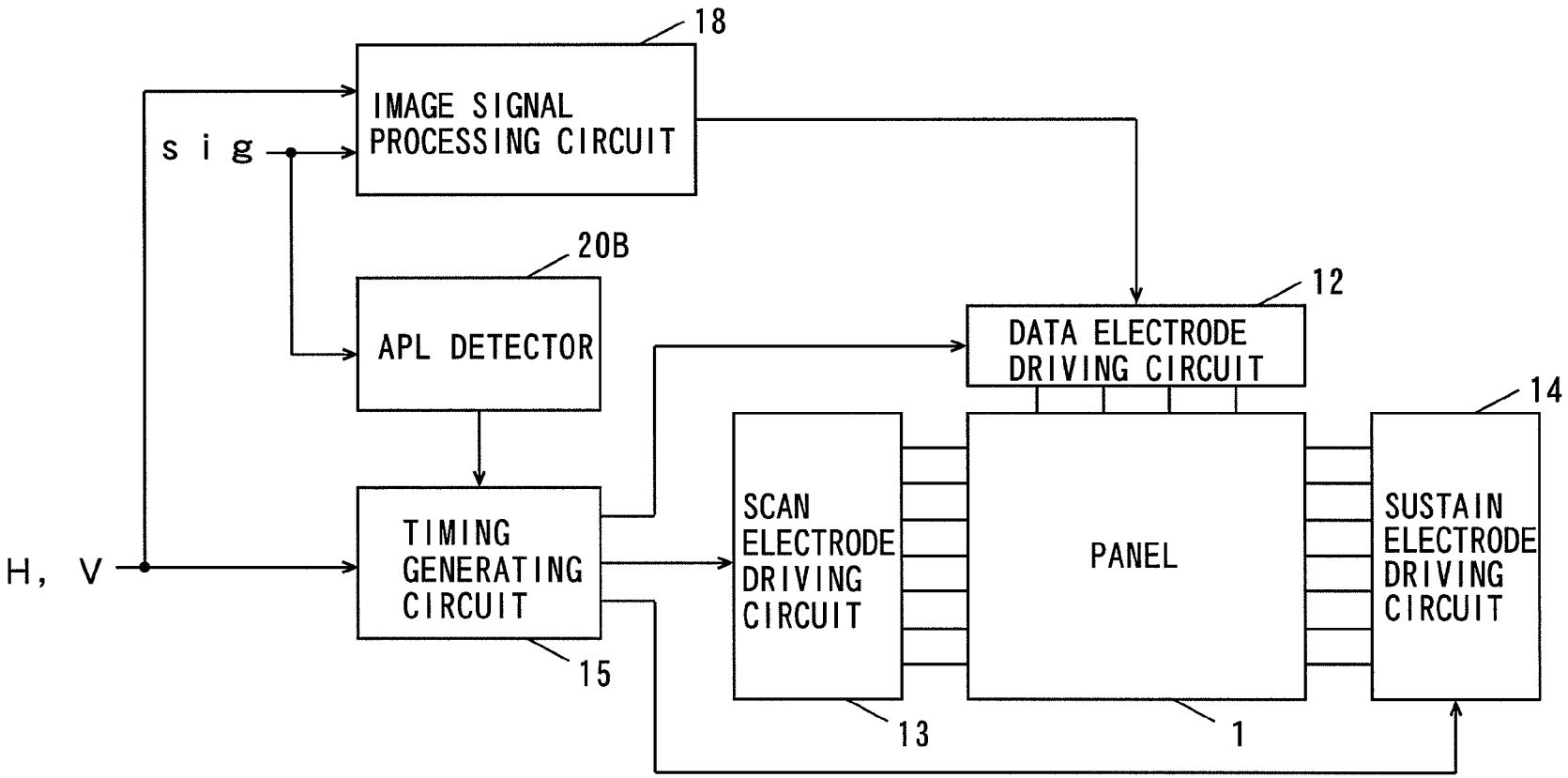
FIG. 10 is a configuration diagram of a plasma display device according to a second embodiment.

FIG. 10 is a configuration diagram of the plasma display device according to the second embodiment. As shown in FIG. 10, the plasma display device according to the present embodiment includes an APL detector 20B instead of the lighting rate detector 20A in the configuration of the plasma display device according to the first embodiment.

The APL detector 20B detects an APL (Average Picture Level) of image signals sig, and outputs a signal indicating the detected APL to the timing generating circuit 15. Here, the APL means an average of luminance levels of the image signals sig in one frame, and represents overall brightness of the image in one screen. In the present embodiment, one frame equals to one field.

Also in the plasma display device according to the present embodiment, the sustain electrodes SU are brought into the high impedance state at predetermined timings in the first half period and the second half period of the setup period in which the setup operation for all the cells is performed as shown in the example of FIG. 6. Accordingly, the rising ramp waveform and the dropping ramp waveform are applied to the sustain electrodes SU.

In the present embodiment, the peak values of the ramp waveform are controlled depending on a value of the APL detected by the APL detector 20B of FIG. 10. The reason will be explained.

In the plasma display device according to the present embodiment, the number of the sustain pulses applied to the sustain electrodes SU is changed depending on the value of the APL detected by an APL detecting circuit 20.

Specifically, the number of the sustain pulses per one field is increased as the value of the APL is lowered. This causes power to be held constant while emphasizing the contrast of the image.

Accordingly, as the value of the APL is lower and the number of the sustain pulses is larger in the preceding field, the amount of priming generated with the sustain discharges in the preceding field inside the discharge cells DC is increased at a starting point of the subsequent field. This lowers the discharge start voltage between the scan electrodes SC and the sustain electrodes SU during the first half period (FIG. 6) in the setup period.

That is, when the image with the low APL value is displayed in the preceding field, the discharges are easily generated between the scan electrodes SC and the sustain electrodes SU in the first half period of the setup period. Note that the priming means an excited particle that serves as an initiating agent for the discharge.

Meanwhile, the number of the sustain pulses per one field is decreased as the value of the APL is higher. In this case, as the value of the APL is higher and the number of the sustain pulses is smaller in the preceding field, the amount of the priming generated with the sustain discharges in the preceding field inside the discharge cells DC is decreased at the starting point of the subsequent field. This rises the discharge start voltage between the scan electrodes SC and the sustain electrodes SU during the first half period (FIG. 6) in the setup period.

That is, when the image with the high APL value is displayed in the preceding field, the discharges are unlikely to be generated between the scan electrodes SC and the sustain electrodes SU in the first half period of the setup period.

In the present embodiment, the timing at which the rising ramp waveform is applied to the sustain electrodes SU during the first half period is required to be set so as to be later than generation of weak discharges between the scan electrodes SC and the sustain electrodes SU in all the discharge cells DC.

Therefore, the timing at which the rising ramp waveform is applied to the sustain electrodes SU during the first half period is suitably controlled depending on the value of the APL detected by the APL detector 20B in the present invention. Thus, the peak value of the rising ramp waveform applied to the sustain electrodes SU is controlled, so that the respective wall charges on the electrodes SC, SU and DA are adjusted and unnecessary discharges are reduced.

Specifically, since the discharge start voltage is lowered when the image with the low APL value is displayed in the preceding field, for example, the timing at which the rising ramp waveform is applied to the sustain electrodes SU during the first half period is advanced. Thus, a period of the setup discharges between the scan electrodes SC and the sustain electrodes SU is shortened and the peak value of the rising ramp waveform is increased. This prevents the amount of the wall charges stored in the scan electrodes SC and the sustain electrodes SU from being excessively increased after the rising ramp waveform is applied in the first half period. That is, the amount of the wall charges on the scan electrodes SC and the sustain electrodes SU can be reduced.

In this case, the timing at which the dropping ramp waveform is applied to the sustain electrodes SU is advanced depending on the amount of the wall charges stored on the scan electrodes SC and the sustain electrodes SU at the end of the first half period to increase the peak value of the dropping ramp waveform in the second half period following the first half period in order to stably generate the write discharges in the write period. This prevents the wall charges stored on the scan electrodes SC and the sustain electrodes SU in the first half period from being excessively reduced by the setup discharges in the second half period. Accordingly, the respective amounts of the wall charges stored in the scan electrodes SC, the sustain electrodes SU and the data electrodes DA are adjusted to values suitable for the write discharges. As a result, the image with the improved display quality and contrast can be obtained.

Conversely, since the discharge start voltage becomes higher when the image with the high APL value is displayed in the preceding field, for example, the timing at which the rising ramp waveform is applied to the sustain electrodes SU during the first half period is delayed to decrease the peak value of the rising ramp waveform. Accordingly, the period of the setup discharges between the scan electrodes SC and the sustain electrodes SU is lengthened. This prevents the amount of the wall charges stored in the scan electrodes SC and the sustain electrodes SU from being excessively decreased after the rising ramp waveform is applied in the first half period. That is, the amount of the wall charges on the scan electrodes SC and the sustain electrodes SU can be increased.

In this case, the timing at which the dropping ramp waveform is applied to the sustain electrodes SU is delayed depending on the amount of the wall charges stored on the scan electrodes SC and the sustain electrodes SU at the end of the first half period to decrease the peak value of the dropping ramp waveform in the second half period following the first half period in order to stably generate the write discharges in the write period. This prevents the possibility that the wall charges stored on the scan electrodes SC and the sustain electrodes SU during the first half period cannot be sufficiently reduced by the setup discharges in the second half period. Accordingly, the respective amounts of the wall charges stored on the scan electrodes SC, the sustain electrodes SU and the data electrodes DA are adjusted to values suitable for the write discharges. As a result, the image with the improved display quality and contrast can be obtained.

As described above, when the application timing of the rising ramp waveform to the sustain electrodes SU in the first half period is shifted depending on the value of the APL to change the peak value of the rising ramp waveform, similarly in the second half period, the application timing of the dropping ramp waveform to the sustain electrodes SU is suitably shifted to suitably change the peak value of the dropping ramp waveform. This allows the write discharges in the write period to be stably generated and the image with an excellent quality to be displayed on the panel 1.

It is desired that the peak values of the rising and dropping ramp waveform of the sustain electrodes SU are gradually changed depending on the APL detected by the APL detector 20B so that the variations in light emission luminance in the setup period are not visually recognized. This gradual change is preferably performed so that the variations in the light emission luminance in the setup period are not visually recognized, and can be performed using the hysteresis function, for example.

The sustain electrode driving circuit 14 (FIG. 10) having the same configuration as the sustain electrode driving circuit 14 of FIG. 7 described in the first embodiment is used also in the plasma display device according to the second embodiment.

Figure 11:
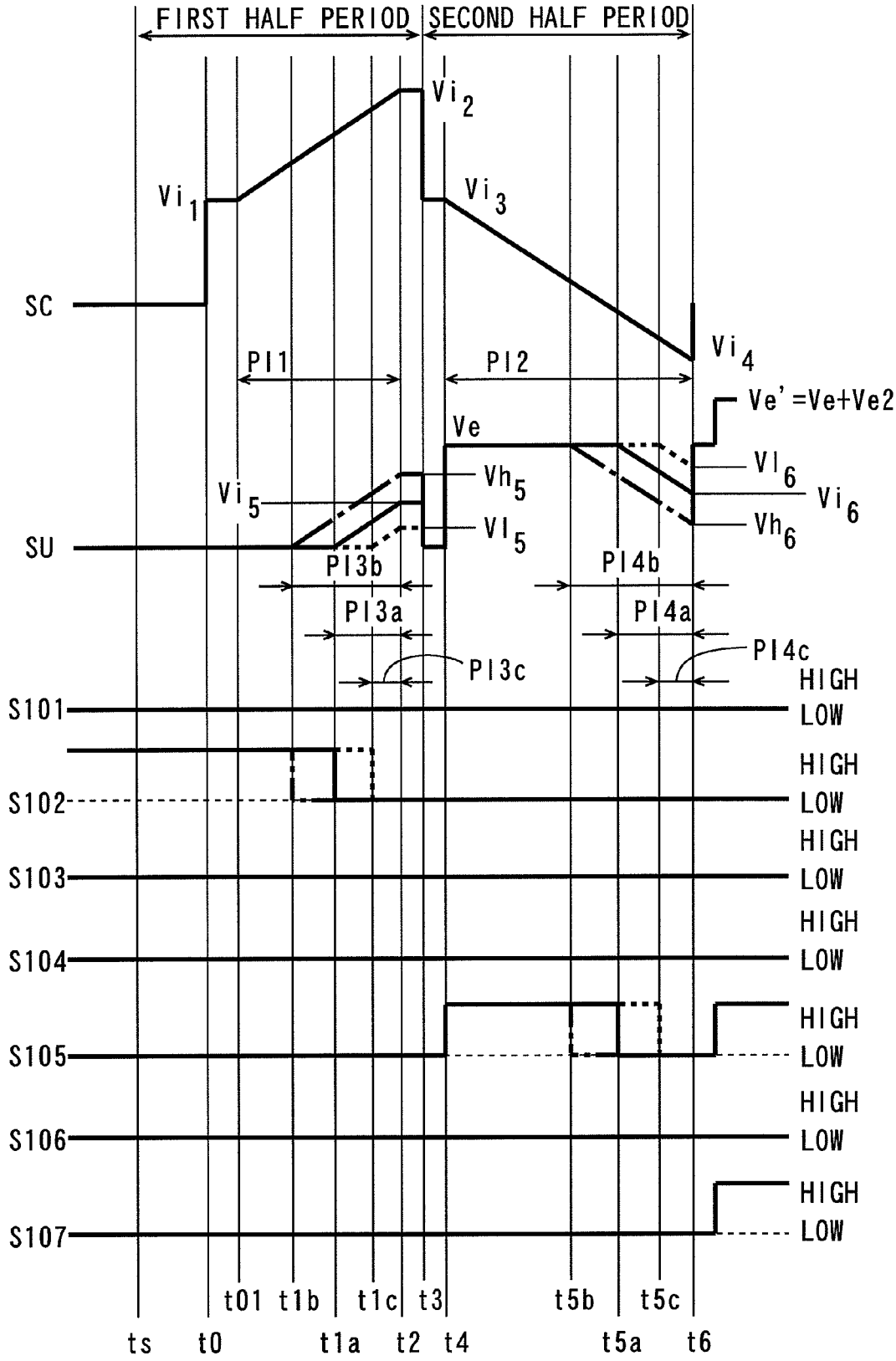
FIG. 11 is a chart showing driving voltage waveforms supplied to the scan electrodes and the sustain electrodes and timings of the control signals supplied to the sustain electrode driving circuit in the setup period of the first SF of FIG. 4 in the plasma display device according to the second embodiment.

FIG. 11 is a chart showing the driving voltage waveforms supplied to the scan electrodes SC and the sustain electrodes SU and timings of the control signals supplied to the sustain electrode driving circuit 14 in the setup period of the first SF of FIG. 4 in the plasma display device according to the second embodiment.

In FIG. 11, the driving voltage waveform of the scan electrodes SC is shown in the uppermost stage and the driving voltage waveform of the sustain electrodes SU is shown in the next stage.

In the present embodiment, the control signals S102, S105 supplied to the sustain electrodes SU vary depending on the value of the APL detected by the APL detector 20B. Specifically, the control signals S102, S105 are different in respective cases where the value of the APL is low, about intermediate, and high.

First, description is made of the case where the value of the APL is about intermediate. The control signals S101, S103, S104, S105, S106, S107 are at low levels, and the control signal S102 is at a high level at a starting point is of the first SF. Thus, the transistors Q101, Q103, Q104, Q105*a*, Q105*b*, Q106, Q107 are turned off and the transistor Q102 is turned on. Accordingly, the sustain electrodes SU (the node N101 of FIG. 7) are at the ground potential.

Thereafter, the potential of the scan electrodes SC rises to $Vi_1$ at a time point t0. Then, the rising ramp waveform rising from the potential $Vi_1$ to the potential $Vi_2$ is applied to the scan electrodes SC at a time point t01. This ramp waveform is applied to the scan electrodes SC in a first period PI1 from the time point t01 to a time point t2.

After a predetermined period has elapsed since the application of the rising ramp waveform to the scan electrodes SC was started, the control signal S102 attains a low level at a time point t1*a* (see the bold solid line). Thus, the transistor Q102 is turned off. In this case, the sustain electrodes SU are connected to neither the power supply terminal nor the ground terminal. This causes the sustain electrodes SU to be brought into the high impedance state. Accordingly, the potential of the sustain electrodes SU rises to $Vi_5$ in a third period PI3*a* from the time point t1*a* to the time point t2 with the rise of the potential of the scan electrodes SC.

When the sustain electrodes SU are in the high impedance state, the potential difference between the scan electrodes SC and the sustain electrodes SU is held substantially constant. Therefore, the discharges are unlikely to be generated between the scan electrodes SC and the sustain electrodes SU. Since the potential of the scan electrodes SC is maintained constant, the potential of the sustain electrodes SU is also maintained constant in the period from the time point t2 to a time point t3.

At a time point t4, the application of the dropping ramp waveform dropping from the potential $Vi_3$ to the potential $Vi_4$ to the scan electrodes SC is started. This ramp waveform is applied to the scan electrodes SC in a second period PI2 from the time point t4 to a time point t6.

Here, the control signal S105 attains the high level. Thus, the transistors Q105*a*, Q105*b* are turned on. This causes a current to flow from the power supply terminal V102 to the sustain electrodes SU through the node N104. As a result, the potential of the sustain electrodes SU rises to be held at the potential Ve.

After a predetermined period has elapsed since the application of the dropping ramp waveform to the scan electrodes SC was started, the control signal S105 attains the low level at a time point t5*a*. Thus, the transistors Q105*a*, Q105*b* are turned off. In this case, the sustain electrodes SU are connected to neither the power supply terminal nor the ground terminal. This causes the sustain electrodes SU to be again brought into the high impedance state. Accordingly, the potential of the sustain electrodes SU drops to $Vi_6$ in a fourth period PI4*a* from the time point t5*a* to the time point t6 with the drop of the potential of the scan electrodes SC. When the sustain electrodes SU are in the high impedance state, the potential difference between the scan electrodes SC and the sustain electrodes SU is held substantially constant. Therefore, the discharges between the scan electrodes SC and the sustain electrodes SU are unlikely to be generated.

Thereafter, the control signals S105, S107 attain the high levels. This causes the sustain electrodes SU to be held at the potential Ve' obtained by adding the voltage Ve2 to the potential Ve.

Next, description is made of the case where the value of the APL is low. Note that the control signals S102, S105 when the value of the APL is low are indicated by the bold one-dot and dash line in FIG. 11.

When the value of the APL is low, the control signal S102 attains the low level at a time point t1*b* (see the bold one-dot and dash line) after a predetermined period has elapsed since the application of the rising ramp waveform to the scan electrodes SC was started. Thus, the transistor Q102 is turned off. In this case, the sustain electrodes SU are brought into the high impedance state as described above. This causes the potential of the sustain electrodes SU to rise to $Vh_5$ with the rise of the potential of the scan electrodes SC.

Here, the time point t1*b* is set so as to be earlier than the time point t1*a* at which the control signal S102 is switched from the high level to the low level when the value of the APL is about intermediate. Therefore, when the value of the APL is low, the period in which the sustain electrodes SU are in the high impedance state is lengthened (see the third period indicated by the arrow PI3*b*), as compared with the case where the value of the APL is about intermediate. This causes the peak value (the potential difference between the ground potential and the potential $Vh_5$) of the rising ramp waveform applied to the sustain electrodes SU to be larger than the peak value (the potential difference between the ground potential and the potential $Vi_5$) when the value of the APL is about intermediate.

In addition, after a predetermined period has elapsed since the application of the dropping ramp waveform to the scan electrodes SC was started, the control signal S105 attains the low level at a time point t5*b* (see the bold one-dot and dash line). Thus, the transistors Q105*a*, Q105*b*are turned off. In this case, the sustain electrodes SU are brought into the high impedance state as described above. This causes the potential of the sustain electrodes SU to drop to $Vh_6$ with the drop of the potential of the scan electrodes SC.

Here, the time point t5*b* is set so as to be earlier than the time point t5*a* at which the control signal S105 is switched from the high level to the low level when the value of the APL is about intermediate. Therefore, when the value of the APL is low, the period in which the sustain electrodes SU are in the high impedance state is lengthened (see a fourth period indicated by the arrow PI4*b*), as compared with the case where the value of the APL is about intermediate. This causes the peak value (the potential difference between the potential $Vi_3$ and the potential $Vh_6$) of the dropping ramp waveform applied to the sustain electrodes SU to be larger than the peak value (the potential difference between the potential $Vi_3$ and the potential $Vi_6$) when the value of the APL is about intermediate.

When the value of the APL is high, the control signal S102 attains the low level at a time point t1*c* (see the bold dotted line) after a predetermined period has elapsed since the application of the rising ramp waveform to the scan electrodes SC was started. Thus, the transistor Q102 is turned off. In this case, the sustain electrodes SU are brought into the high impedance state as described above. This causes the potential of the sustain electrodes SU to rise to $V1_5$ with the rise of the potential of the scan electrodes SC.

Here, the time point t1*c* is set so as to be later than the time point t1*a* at which the control signal S102 is switched from the high level to the low level when the value of the APL is about intermediate. Therefore, when the value of the APL is high, the period in which the sustain electrodes SU are in the high impedance state is shortened (see a third period indicated by the arrow PI3*c*), as compared with the case where the value of the APL is about intermediate. This causes the peak value (the potential difference between the ground potential and the potential $Vl_5$) of the rising ramp waveform applied to the sustain electrodes SU to be smaller than the peak value (the potential difference between the ground potential and the potential $Vi_5$) when the value of the APL is about intermediate.

In addition, the control signal S105 attains the low level at a time point t5*c* (see the bold dotted line) after a predetermined period has elapsed since the application of the dropping ramp waveform to the scan electrodes SC was started. Thus, the transistors Q105*a*, Q105*b* are turned off. In this case, the sustain electrodes SU are brought into the high impedance state as described above. This causes the potential of the sustain electrodes SU to drop to $Vl_6$ with the drop of the potential of the scan electrodes SC.

Here, the time point t5*c* is set so as to be later than the time point t5*a* at which the control signal S102 is switched from the high level to the low level when the value of the APL is about intermediate. Therefore, when the value of the APL is high, the period in which the sustain electrodes SU are in the high impedance state is shortened (see a fourth period indicated by the arrow PI4*c*), as compared with the case where the value of the APL is about intermediate. This causes the peak value (the potential difference between the potential $Vi_3$ and the potential $Vl_6$) of the dropping ramp waveform applied to the sustain electrodes SU to be smaller than the peak value (the potential difference between the potential $Vi_3$ and the potential $Vi_6$) when the value of the APL is about intermediate.

As described above, the periods (the third period and the fourth period) in which the sustain electrodes SU are in the high impedance state are set so as to be different in respective cases where the value of the APL is low, about intermediate, and high in the plasma display device according to the present embodiment.

That is, the period in which the sustain electrodes SU are in the high impedance state is set longer when the value of the APL is low, the period in which the sustain electrodes SU are in the high impedance state is set about intermediate when the value of the APL is about intermediate, and the period in which the sustain electrodes SU are in the high impedance state is set longer when the value of the APL is high.

Accordingly, the peak values of the ramp waveform generated in the sustain electrodes SU when the value of the APL is low becomes larger than the peak values of the ramp waveform generated when the value of the APL is about intermediate. Meanwhile, the peak value of the ramp waveform generated in the sustain electrodes SU when the value of the APL is high becomes smaller than the peak value of the ramp waveform generated when the value of the APL is about intermediate.

As described above, the periods in which the sustain electrodes SU are in the high impedance state are changed depending on the value of the APL, so that the image with the improved display quality and contrast can be obtained.

FIG. 12 is a table showing an example of the application timings of the ramp waveform to the sustain electrodes SU and the peak values of the ramp waveform set depending on the value of the APL detected by the APL detector 20B. In description of FIG. 12, the peak value of the ramp waveform means a voltage value at the end of the application of the ramp waveform gently rising or dropping with time.

In this example, the application timings of the ramp waveform to the sustain electrodes SU and the peak values of the ramp waveform are set in three levels depending on the value of the APL.

As shown in FIG. 12, when the value of the APL is not less than 0% and not more than 10% (when the value is low), the peak value of the rising ramp waveform applied to the sustain electrodes SU is set at 70 V, for example, and the peak value of the dropping ramp waveform is set at 90 V, for example. The timing at which the sustain electrodes SU are brought into the high impedance state in order to obtain the rising ramp waveform is set at 70 μs, for example. The timing at which the sustain electrodes SU are brought into the high impedance state in order to obtain the dropping ramp waveform is set at 140 μs, for example.

When the value of the APL is higher than 10% and not more than 30% (when the value is about intermediate), the peak value of the rising ramp waveform applied to the sustain electrodes SU is set at 35 V, for example, and the peak value of the dropping ramp waveform is set at 125 V, for example. The timing at which the sustain electrodes SU are brought into the high impedance state in order to obtain the rising ramp waveform is set at 100 μs, for example. The timing at which the sustain electrodes SU are brought into the high impedance state in order to obtain the dropping ramp waveform is set at 170 μs, for example.

When the value of the APL is higher than 30% and not more than 100% (when the value is high), the peak value of the rising ramp waveform applied to the sustain electrodes SU is set at 0 V, for example, and the peak value of the dropping ramp waveform is set at 160 V, for example. The timing at which the sustain electrodes SU are brought into the high impedance state in order to obtain the rising ramp waveform is set at 130 μs, for example. The timing at which the sustain electrodes SU are brought into the high impedance state in order to obtain the dropping ramp waveform is set at 200 μs, for example.

Although the timings and the peak values in FIG. 12 are shown as examples in the present embodiment, it is preferable that these values are suitably set depending on the discharge start voltage between the scan electrodes SC and the sustain electrodes SU in the panel.

In this example, when the value of the APL varies from a value in a range of not less than 0% to not more than 10% to a value in a range of higher than 10% to not more than 30%, the drive condition of the panel 1 is changed depending on the timing and the peak value of the ramp waveform shown in FIG. 12.

When the drive condition of the panel 1 is significantly changed as described above, the variations in the light emission luminance in the setup period may be visually recognized. Therefore, the drive condition may be gradually changed so that the variations in the luminance are not visually recognized.

For example, when the value of the APL varies from the value in the range of not less than 0% to not more than 10% to the value in the range of higher than 10% to not more than 30%, the timing at which the sustain electrodes SU are brought into the high impedance state is shifted by 2 μs in each of the subsequent sub-fields from the field in which the value of the APL varies to the value in the range of higher than 10% to not more than 30%, so that the timing is changed to the desired timing shown in FIG. 12. In this manner, the timing is gradually shifted in each field, so that the timing at which the sustain electrodes SU are brought into the high impedance state is changed so as to come close to the desired timing by degrees. This sufficiently prevents the variations in the luminance from being visually recognized.

Similarly to the foregoing, when the value of the APL varies from the value in the range of higher than 10% to not more than 30% to a value in a range of higher than 30% to not more than 100%, the timing at which the sustain electrodes SU are brought into the high impedance state is shifted by 2 μs in each of the subsequent sub-fields from the field in which the value of the APL varies to the value in the range of higher than 30% to not more than 100%, so that the timing is changed to the desired timing shown in FIG. 12. In this manner, the timing is gradually shifted in each field, so that the timing at which the sustain electrodes SU are brought into the high impedance state is changed so as to come close to the desired timing by degrees. This sufficiently prevents the variations in the luminance from being visually recognized.

The processing similar to the foregoing is performed also when the value of the APL varies from the value in the range of higher than 30% to not more than 100% to the value in the range of higher than 10% to not more than 30% and when the value of the APL varies from the value in the range of higher than 10% to not more than 30% to the value in the range of not less than 0% to not more than 10%. This sufficiently prevents the variations in the luminance from being visually recognized.

As described above, in the example of FIG. 12, the drive condition of the panel 1 is changed depending on which of the ranges the value of the APL belongs to, the ranges including the range of not less than 0% to not more than 10%, the range of higher than 10% to not more than 30%, and the range of higher than 30% to not more than 100%.

In the present embodiment, a hysteresis width may be set in each of the threshold values that classify the ranges. In the example of FIG. 12, 10% and 30% correspond to the threshold values.

For example, the hysteresis widths of 2% are set over and under the threshold value of 30%, respectively. Such hysteresis widths are set, so that the drive condition of the panel 1 can be changed as follows.

For example, when the value of the APL varies from the value higher than 30% to the value not more than 30%, the drive condition of the panel 1 is changed depending on the timing and the peak value of the ramp waveform shown in FIG. 12; however, when the value of the APL subsequently rises, the drive condition of the panel 1 is not changed until the value of the APL attains a value higher than 32%.

Such a hysteresis control prevents the luminance of the image from being significantly changed when the value of the APL of the image to be displayed is about 30%, for example. This sufficiently prevents the variations in the light emission luminance in the setup period from being visually recognized.

While the present embodiment describes the panel 1 driven depending on which of the three ranges the value of the APL belongs to as shown in FIG. 12, it is desirable that these ranges are optimally set depending on the discharge start voltage of the panel 1. In addition, while the present embodiment describes the three ranges set for the value of the APL, two ranges or four ranges may be set for the value of the APL.

Third Embodiment

Hereinafter, a plasma display device according to a third embodiment is described by referring to differences from the plasma display device according to the first embodiment.

Figure 13:
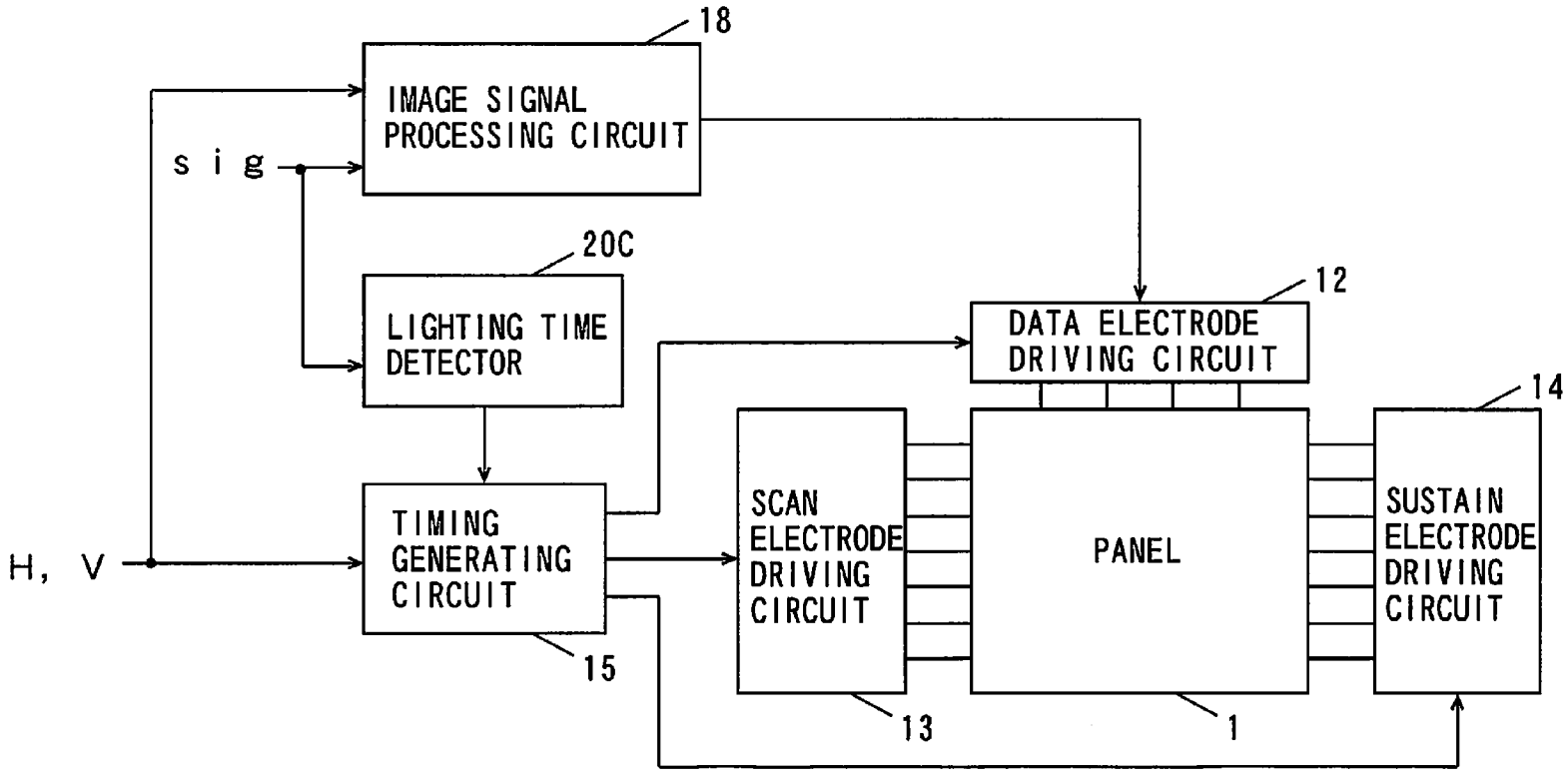
FIG. 13 is a configuration diagram of a plasma display device according to a third embodiment.

FIG. 13 is a configuration diagram of the plasma display device according to the third embodiment. As shown in FIG. 13, the plasma display device according to the present embodiment includes a lighting time detector 20C instead of the lighting rate detector 20A in the configuration of the plasma display device according to the first embodiment.

The lighting time detector 20C detects a cumulative lighting time in the panel 1 by monitoring an input state of the image signal sig, and supplies the value to the timing generating circuit 15. Here, the cumulative lighting time means a cumulative value of a state where the plasma display device is turned on by a user, specifically, a duration in which the panel 1 is in a driving state. In the following description, an operation for bringing the panel 1 into the driving state is called a turn-on operation, and an operation for bringing the panel 1 into a non-driving state is called a turn-off operation.

Also in the plasma display device according to the present embodiment, the sustain electrodes SU are brought into the high impedance state at predetermined timing during the first half period and the second half period of the setup period in which the setup operation for all the cells is performed as shown in the example of FIG. 6. This causes the rising ramp waveform and the dropping ramp waveform to be applied to the sustain electrodes SU.

Here, the peak value of the ramp waveform is controlled depending on the cumulative lighting time detected by the lighting time detector 20C of FIG. 13 in the present embodiment. The reason will be explained.

Generally, the discharge start voltage between the scan electrodes SC and the sustain electrodes SU varies depending on the cumulative lighting time of the panel 1 in the plasma display device. Specifically, the discharge start voltage between the scan electrodes SC and the sustain electrodes SU becomes higher as the cumulative lighting time becomes longer.

In this case, the discharges are unlikely to be generated between the scan electrodes SC and the sustain electrodes SU during the first half period in the setup period of the first SF (the setup sub-field for all the cells).

In the present embodiment, the timing at which the rising ramp waveform is applied to the sustain electrodes SU during the first half period is required to be set so as to be later than generation of the weak discharges between the scan electrodes SC and the sustain electrodes SU in all the discharge cells DC.

Therefore, the timing at which the rising ramp waveform is applied to the sustain electrodes SU during the first half period is suitably controlled depending on the cumulative lighting time detected by the lighting time detector 20C in the present invention. Accordingly, the peak value of the rising ramp waveform applied to the sustain electrodes SU is controlled, and the respective wall charges of the electrodes SC, SU, DA are adjusted.

Specifically, when the cumulative lighting time becomes longer than a predetermined threshold value, the timing at which the rising ramp waveform is applied to the sustain electrodes SU during the first half period is delayed depending on the rise of the discharge start voltage to decrease the peak value of the rising ramp waveform, for example.

This prevents the period of the setup discharges between the scan electrodes SC and the sustain electrodes SU from being shortened with the rise of the discharge start voltage. Accordingly, the amount of the wall charges stored in the scan electrodes SC and the sustain electrodes SU is prevented from being excessively decreased after the application of the rising ramp waveform during the first half period.

Moreover, in this case, the timing at which the dropping ramp waveform is applied to the sustain electrodes SU during the second half period is delayed to decrease the peak value of the dropping ramp waveform in order to stably generate the write discharges in the write period.

This prevents the possibility that the wall charges stored on the scan electrodes SC and the sustain electrodes SU during the first half period cannot be sufficiently reduced by the setup discharges in the second half period. Accordingly, the amounts of the wall charges stored on the scan electrodes SC, the sustain electrodes SU and the data electrodes DA are adjusted to values suitable for the write discharges. As a result, the image with the improved display quality and contrast can be obtained.

The timings at which the peak values of the rising and dropping ramp waveform of the sustain electrodes SU are changed depending on the foregoing cumulative lighting time are preferably set to a timing at which the turn-off operation is performed after the cumulative lighting time becomes longer than the predetermined threshold value and the turn-on operation is then performed, for example. In this manner, the ramp waveform applied to the sustain electrodes SU is changed at the timing of the turn-on operation and the turn-off operation, so that the variations in the light emission luminance in the setup period are unlikely to be visually recognized.

Also in the plasma display device according to the third embodiment, the sustain electrode driving circuit 14 (FIG. 13) having the same configuration as the sustain electrode driving circuit 14 of FIG. 7 described in the first embodiment is employed.

The scan electrodes SC and the sustain electrodes SU of the plasma display device according to the third embodiment can be driven using the driving voltage waveforms of FIG. 8 described in the first embodiment, for example. Hereinafter, description is made of the operations of the scan electrodes SC and the sustain electrodes SU and the control signals supplied to the sustain electrode driving circuit 14 (FIG. 13) while referring to FIG. 8.

In the present embodiment, the control signals S102, S105 supplied to the sustain electrodes SU vary depending on the cumulative lighting time detected by the lighting time detector 20C. Specifically, the control signals S102, S105 are different in respective cases where the cumulative lighting time is not more than a predetermined threshold value and where the cumulative lighting time is longer than the predetermined threshold value.

First, description is made of a case where the cumulative lighting time is not more than the predetermined threshold value. At the starting point is of the first SF, the control signals S101, S103, S104, S105, S106 and S107 are at the low levels, and the control signal S102 is at the high level. Thus, the transistors Q101, Q103, Q104, Q105*a*, Q105*b*, Q106, Q107 are turned off and the transistor Q102 is turned on. Accordingly, the sustain electrodes SU (the node N101 of FIG. 7) are at the ground potential.

Thereafter, the potential of the scan electrodes SC rises to $Vi_1$ at the time point t0. Then, the rising ramp waveform rising from the potential $Vi_1$ to the potential $Vi_2$ is applied to the scan electrodes SC at the time point t01. This ramp waveform is applied to the scan electrodes SC in the first period PI1 from the time point t01 to the time point t2.

After a predetermined period has elapsed since the application of the rising ramp waveform to the scan electrodes SC was started, the control signal S102 attains the low level at the time point t1*a* (see the bold solid line). Thus, the transistor Q102 is turned off. In this case, the sustain electrodes SU are connected to neither the power supply terminal nor the ground terminal. As a result, the sustain electrodes SU are brought into the high impedance state. This causes the potential of the sustain electrodes SU to rise to $Vi_5$ in the third period PI3 from the time point t1*a* to the time point t2 with the rise of the potential of the scan electrodes SC.

When the sustain electrodes SU are in the high impedance state, the potential difference between the scan electrodes SC and the sustain electrodes SU is held substantially constant. Therefore, the discharges are unlikely to be generated between the scan electrodes SC and the sustain electrodes SU. Since the potential of the scan electrodes SC is maintained constant, the potential of the sustain electrodes SU is also maintained constant in the period from the time point t2 to the time point t3.

At the time point t4, the application of the dropping ramp waveform dropping from the potential $Vi_3$ to the potential $Vi_4$ to the scan electrodes SC is started. This ramp waveform is applied to the scan electrodes SC in the second period PI2 from the time point t4 to the time point t6.

Here, the control signal S105 attains the high level. Thus, the transistors Q105*a*, Q105*b* are turned on. This causes a current to flow from the power supply terminal V102 to the sustain electrodes SU through the node N104. As a result, the potential of the sustain electrodes SU rises to be held at the potential Ve.

After a predetermined period has elapsed since the application of the dropping ramp waveform to the scan electrodes SC was started, the control signal S105 attains the low level at the time point t5*a*. Thus, the transistors Q105*a*, Q105*b* are turned off. In this case, the sustain electrodes SU are connected to neither the power supply terminal nor the ground terminal. As a result, the sustain electrodes SU are again brought into the high impedance state. This causes the potential of the sustain electrodes SU to drop to $Vi_6$ in the fourth period PI4 from the time point t5*a* to the time point t6 with the drop of the potential of the scan electrodes SC. When the sustain electrodes SU are in the high impedance state, the potential difference between the scan electrodes SC and the sustain electrodes SU is held substantially constant. Therefore, the discharges are unlikely to be generated between the scan electrodes SC and the sustain electrodes SU.

Thereafter, the control signals S105, S107 attain the high levels. This causes the sustain electrodes SU to be held at the potential Ve' obtained by adding the voltage Ve2 to the potential Ve.

Next, description is made of a case where the cumulative lighting time becomes longer than the predetermined threshold value. When the cumulative lighting time becomes longer than the predetermined threshold value, the control signal S102 attains the low level at the time point t1*b* (see the bold dotted line) after a predetermined period has elapsed since the application of the rising ramp waveform to the scan electrodes SU was started. Thus, the transistor Q102 is turned off. In this case, the sustain electrodes SU are brought into the high impedance state as described above. This causes the potential of the sustain electrodes SU to rise to $Vi_5'$ with the rise of the potential of the scan electrodes SC.

Here, the time point t1*b* is set so as to be later than the time point t1*a* at which the control signal S102 is switched from the high level to the low level when the cumulative lighting time is not more than the predetermined threshold value. Therefore, when the cumulative lighting time is longer than the predetermined threshold value, the period in which the sustain electrodes SU are in the high impedance state is shortened (see the third period indicated by the arrow PI3'), as compared with a case where the cumulative lighting time is not more than the predetermined threshold value. As a result, the peak value (the potential difference between the ground potential and the potential $Vi_5'$) of the rising ramp waveform applied to the sustain electrodes SU becomes smaller than the peak value (the potential difference between the ground potential and the potential $Vi_5$) when the cumulative lighting time is not more than the predetermined threshold value.

Moreover, the control signal S105 attains the low level at the time point t5*b* (see the bold dotted line) after a predetermined period has elapsed since the application of the dropping ramp waveform to the scan electrodes SC was started. Thus, the transistors Q105*a*, Q105*b* are turned off. In this case, the sustain electrodes SU are brought into the high impedance state as described above. Accordingly, the potential of the sustain electrodes SU drops to Vi6' with the drop of the potential of the scan electrodes SC.

Here, the time point t5*b* is set so as to be later than the time point t5*a* at which the control signal S105 is switched from the high level to the low level when the cumulative lighting time is not more than the predetermined threshold value. Therefore, when the cumulative lighting time is longer than the predetermined threshold value, the period in which the sustain electrodes SU are in the high impedance state is shortened (see the fourth period indicated by the arrow PI4'), as compared with a case where the cumulative lighting time is not more than the predetermined threshold value. As a result, the peak value (the potential difference between the potential $Vi_3$ and the potential $Vi_6'$) of the dropping ramp waveform applied to the sustain electrodes SU becomes smaller than the peak value (the potential difference between the potential $Vi_3$ and the potential $Vi_6$) when the cumulative lighting time is not more than the predetermined threshold value.

As described above, in the plasma display device according to the present embodiment, the periods (the third period and the fourth period) in which the sustain electrodes SU are in the high impedance state are set longer when the cumulative lighting time is not more than the predetermined threshold value, and the periods in which the sustain electrodes SU are in the high impedance state are set shorter when the cumulative lighting time is longer than the predetermined threshold value. Accordingly, the image with the improved display quality and contrast can be obtained.

FIG. 14 is a table showing an example of the application timings of the ramp waveform to the sustain electrodes SU and the peak values of the ramp waveform set depending on the cumulative lighting time detected by the lighting time detector 20C. In description of FIG. 14, the peak value of the ramp waveform means a voltage value at the end of the application of the ramp waveform gently rising or dropping with time.

In this example, the application timings of the ramp waveform to the sustain electrodes SU and the peak values of the ramp waveform are set in three levels depending on the cumulative lighting time.

As shown in FIG. 14, when the cumulative lighting time is not less than zero and not more than 500 hours, the peak value of the rising ramp waveform applied to the sustain electrodes SU is set at 70 V, for example, and the peak value of the dropping ramp waveform is set at 90 V, for example. Moreover, the timing at which the sustain electrodes SU are brought into the high impedance state in order to obtain the rising ramp waveform is set at 70 μs, for example. The timing at which the sustain electrodes SU are brought into the high impedance state in order to obtain the dropping ramp waveform is set at 140 μs, for example.

Next, when the cumulative lighting time is longer than 500 hours and not more than 1500 hours, the peak value of the rising ramp waveform applied to the sustain electrodes SU is set at 35 V, for example, and the peak value of the dropping ramp waveform is set at 125 V, for example. The timing at which the sustain electrodes SU are brought into the high impedance state in order to obtain the rising ramp waveform is set at 100 μs, for example. The timing at which the sustain electrodes SU are brought into the high impedance state in order to obtain the dropping ramp waveform is set at 170 μs, for example.

When the cumulative lighting time is longer than 1500 hours, the peak value of the rising ramp waveform applied to the sustain electrodes SU is set at 0 V, for example, and the peak value of the dropping ramp waveform is set at 160 V, for example. The timing at which the sustain electrodes SU are brought into the high impedance state in order to obtain the rising ramp waveform is set at 130 μs, for example. The timing at which the sustain electrodes SU are brought into the high impedance state in order to obtain the dropping ramp waveform is set at 200 μs, for example.

Although the timings and the peak values in FIG. 14 are shown as examples in the present embodiment, it is preferable that these values are suitably set depending on the discharge start voltage between the scan electrodes SC and the sustain electrodes SU in the panel 1.

While the present embodiment describes the panel 1 driven depending on which of the three ranges the cumulative lighting time belongs to as shown in FIG. 14, it is desirable that these ranges are optimally set depending on the discharge start voltage of the panel 1. In addition, while the present embodiment describes the three ranges set for the cumulative lighting time, two ranges or four ranges may be set for the cumulative lighting time.

The cumulative lighting time is detected by the lighting time detector 20C monitoring the input state of the image signal sig in the present embodiment; however, instead, the cumulative lighting time may be detected by monitoring a switching signal of a switch for performing the turn-on operation and the turn-off operation. Thus, the lighting time detector 20C may be provided separately from the configuration shown in FIG. 13.

Fourth Embodiment

Hereinafter, a plasma display device according to a fourth embodiment is described by referring to differences from the plasma display device according to the first embodiment.

Figure 15:
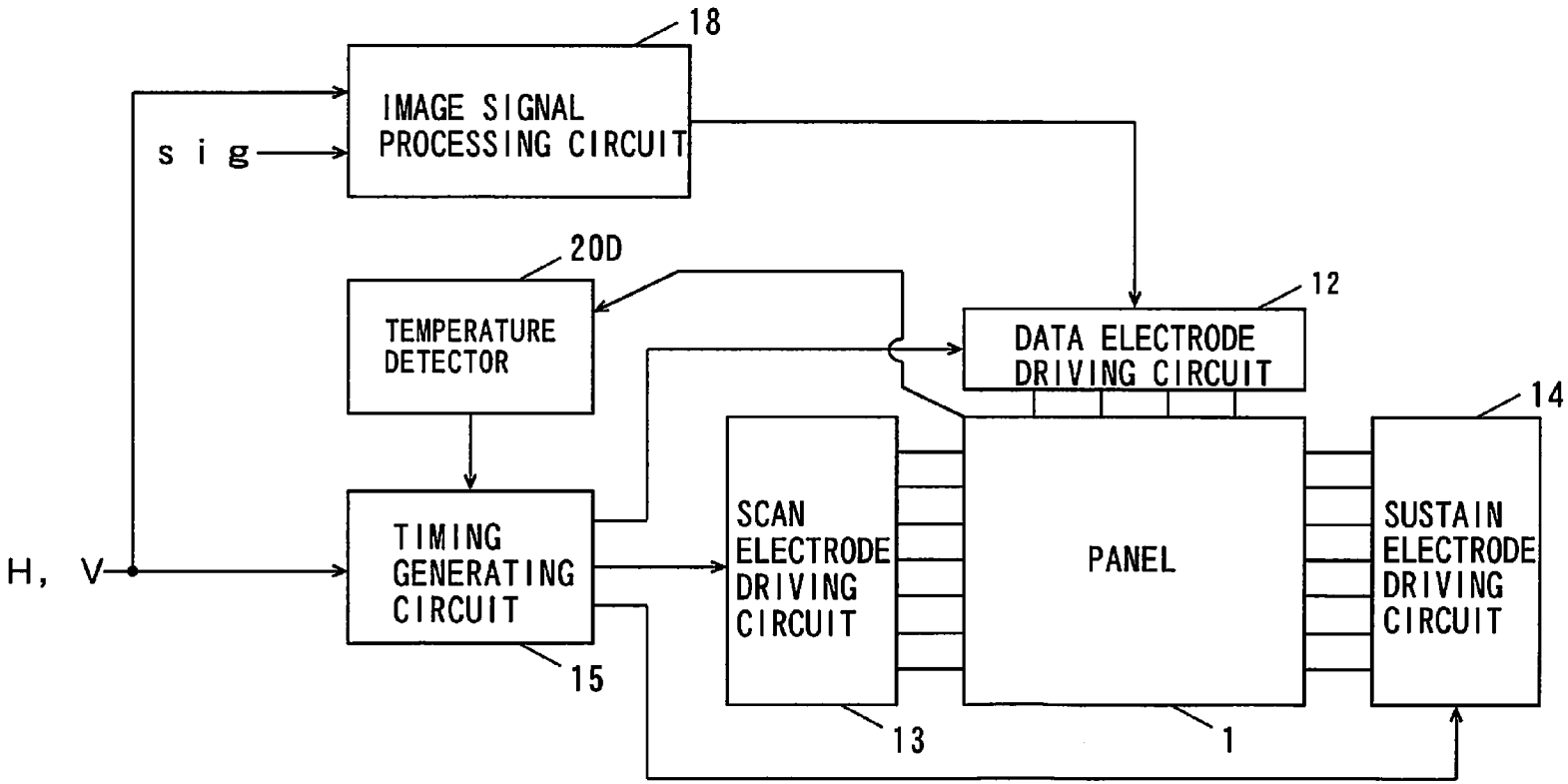
FIG. 15 is a configuration diagram of a plasma display device according to a fourth embodiment.

FIG. 15 is a configuration diagram of the plasma display device according to the fourth embodiment. As shown in FIG. 15, the plasma display device according to the present embodiment includes a temperature detector 20D instead of the lighting rate detector 20A in the configuration of the plasma display device according to the first embodiment.

The temperature detector 20D detects the temperature of the panel 1, and inputs the value to the timing generating circuit 15. Note that the temperature detector 20D may be provided so as to be in contact with the panel 1, or may be provided so as to be spaced apart from the panel 1. For example, the temperature detector 20D may be provided on a circuit board attached to the back side of the panel 1.

Also in the plasma display device according to the present embodiment, the sustain electrodes SU are brought into the high impedance state at predetermined timings during the first half period and the second half period of the setup period in which the setup operation for all the cells is preformed as shown in the example of FIG. 6. Thus, the rising ramp waveform and the dropping ramp waveform are applied to the sustain electrodes SU.

Here, the peak value of the ramp waveform is controlled depending on the temperature of the panel 1 detected by the temperature detector 20D of FIG. 15 in the present embodiment. The reason will be explained.

Generally, the discharge start voltage between the scan electrodes SC and the sustain electrodes SU varies depending on the temperature of the panel 1 in the plasma display device. Specifically, the discharge start voltage between the scan electrodes SC and the sustain electrodes SU becomes higher as the temperature of the panel 1 is lower.

In this case, the discharges are unlikely to be generated between the scan electrodes SC and the sustain electrodes SU during the first half period in the setup period of the first SF (the setup sub-field for all the cells).

In the present embodiment, the timing at which the rising ramp waveform is applied to the sustain electrodes SU during the first half period is required to be set so as to be later than generation of the weak discharges between the scan electrodes SC and the sustain electrodes SU in all the discharge cells DC.

Therefore, the timing of applying the rising ramp waveform to the sustain electrodes SU during the first half period is suitably controlled depending on the temperature of the panel 1 detected by the temperature detector 20D in the present invention. Accordingly, the peak value of the rising ramp waveform applied to the sustain electrodes SU is controlled, and the respective wall charges of the electrodes SC, SU, DA are adjusted.

Specifically, the timing at which the rising ramp waveform is applied to the sustain electrodes SU during the first half period is delayed depending on the value of the discharge start voltage to decrease the peak value of the rising ramp waveform when the temperature of the panel 1 is lower than the predetermined threshold value, for example.

Accordingly, even when the discharge start voltage is high, the period of the setup discharges between the scan electrodes SC and the sustain electrodes SU can be sufficiently lengthened. This prevents the amount of the wall charges stored in the scan electrodes SC and the sustain electrodes SU from being excessively decreased after the application of the rising ramp waveform in the first half period.

Furthermore, in this case, the timing at which the dropping ramp waveform is applied to the sustain electrodes SU during the second half period is delayed to decrease the peak value of the dropping ramp waveform in order to stably generate the write discharges in the write period.

Note that it is desirable that the peak value of the ramp waveform applied to the sustain electrodes SU is gradually changed depending on the temperature of the panel 1 so that the variations in the light emission luminance in the setup period are not visually recognized. This gradual change is preferably performed so that the variations in the light emission luminance in the setup period are not visually recognized, and the hysteresis function can be employed, for example.

Also in the plasma display device according to the fourth embodiment, the sustain electrode driving circuit 14 (FIG. 15) having the same configuration as the sustain electrode driving circuit 14 of FIG. 7 described in the first embodiment is employed.

The scan electrodes SC and the sustain electrodes SU of the plasma display device according to the fourth embodiment can be driven using the driving voltage waveforms of FIG. 8 described in the first embodiment, for example. Hereinafter, description is made of the operations of the scan electrodes SC and the sustain electrodes SU and the control signals supplied to the sustain electrode driving circuit 14 (FIG. 13) while referring to FIG. 8.

In the present embodiment, when the temperature of the panel 1 is high, the control signal S102 attains the low level after a predetermined period has elapsed since the application of the rising ramp waveform to the scan electrodes SC was started, for example, at the time point t1*a*. Accordingly, the sustain electrodes SU are in the high impedance state in the third period PI3 from the time point t1*a* to the time point t2.

Meanwhile, when the temperature of the panel 1 is low, the control signal S102 attains the low level at the time point t1*b*, for example, which is later than the time point t1*a*. Thus, the sustain electrodes SU are in the high impedance state in the third period (the arrow PI3' of FIG. 8) from the time point t1*b*to the time point t2.

As described above, the control signal S102 is switched depending on the temperature of the panel 1, so that, when the temperature of the panel 1 is low, the period in which the sustain electrodes SU are in the high impedance state in the first half period is shortened, as compared with the case where the temperature of the panel 1 is high. Accordingly, the peak value of the rising ramp waveform generated in the sustain electrodes SU when the temperature of the panel 1 is low becomes smaller than the peak value of the rising ramp waveform generated in the sustain electrodes SU when the temperature of the panel 1 is high.

In addition, when the temperature of the panel 1 is high, the control signal S105 attains the low level after a predetermined period has elapsed since the application of the dropping ramp waveform to the scan electrodes SC was started, for example, at the time point t5*a*. Thus, the sustain electrodes SU are in the high impedance state in the fourth period PI4 from the time point t5*a* to the time point t6.

Meanwhile, when the temperature of the panel 1 is low, the control signal S105 attains the low level at the time point t5*b* that is later than the time point t5*a*, for example. Accordingly, the sustain electrodes SU are in the high impedance state in the fourth period (the arrow PI4' of FIG. 8) from the time point t5*b* to the time point t6.

In this manner, the control signal S105 is switched depending on the temperature of the panel 1, so that, when the temperature of the panel 1 is low, the period in which the sustain electrodes SU are in the high impedance state in the first half period is shortened, as compared with the case where the temperature of the panel 1 is high. Thus, the peak value of the dropping ramp waveform generated in the sustain electrodes SU when the temperature of the panel 1 is low becomes smaller than the peak value of the dropping ramp waveform generated in the sustain electrodes SU when the temperature of the panel 1 is high.

As described above, in the plasma display device according to the present embodiment, the periods (the third period and the fourth period) in which the sustain electrodes SU are in the high impedance state are set shorter when the temperature of the panel 1 is low. Thus, the peak value of the ramp waveform generated in the sustain electrodes SU becomes smaller as the temperature of the panel 1 is lower. This allows the image with an excellent display quality to be constantly displayed regardless of the temperature variations of the panel 1.

Note that one or plurality of threshold values for the temperature of the panel 1 may be provided and the peak value of the ramp waveform of the sustain electrodes SU may be changed on the basis of the threshold values in the present embodiment.

FIG. 16 is a table showing an example of the application timings of the ramp waveform to the sustain electrodes SU and the peak values of the ramp waveform set depending on the temperature detected by the temperature detector 20D. In description of FIG. 16, the peak value of the ramp waveform means a voltage value at the end of the application of the ramp waveform gently rising or dropping with time.

In this example, the application timings of the ramp waveform to the sustain electrodes SU and the peak values of the ramp waveform are set in three levels depending on the value of the temperature.

As shown in FIG. 16, when the temperature of the panel 1 is not more than 5° C., the peak value of the rising ramp waveform generated in the sustain electrodes SU is set at 0 V, for example, and the peak value of the dropping ramp waveform is set at 160 V, for example. The timing at which the sustain electrodes SU are brought into the high impedance state in order to obtain the rising ramp waveform is set at 130 μs, for example. The timing at which the sustain electrodes SU are brought into the high impedance state in order to obtain the dropping ramp waveform is set at 200 μs, for example.

When the temperature of the panel 1 is higher than 5° C. and not more than 25° C., the peak value of the rising ramp waveform generated in the sustain electrodes SU is set at 35 V, for example, and the peak value of the dropping ramp waveform is set at 125 V, for example. The timing at which the sustain electrodes SU are brought into the high impedance state in order to obtain the rising ramp waveform is set at 100 μs, for example. The timing at which the sustain electrodes SU are brought into the high impedance state in order to obtain the dropping ramp waveform is set at 170 μs, for example.

When the temperature of the panel 1 is higher than 25° C., the peak value of the rising ramp waveform generated in the sustain electrodes SU is set at 70 V, for example, and the peak value of the dropping ramp waveform is set at 90 V, for example. In addition, the timing at which the sustain electrodes SU are brought into the high impedance state in order to obtain the rising ramp waveform is set at 70 μs, for example. The timing at which the sustain electrodes SU are brought into the high impedance state in order to obtain the dropping ramp waveform is set at 140 μS, for example.

Note that the drive condition of the panel 1 may be gradually changed so that the variations in the luminance are not visually recognized.

For example, when the temperature of the panel 1 varies from a value not more than 5° C. to a value higher than 5° C., the timing at which the sustain electrodes SU are brought into the high impedance state is delayed by 2 μs in each of the subsequent fields, so that the timing is changed to the desired timing shown in FIG. 16.

Similarly, when the temperature of the panel 1 varies from the value not less than 5° C. to the value lower than 5° C., the timing at which the sustain electrodes SU are brought into the high impedance state is advanced by 2 μs in each of the subsequent fields, so that the timing is changed to the desired timing shown in FIG. 16.

In this manner, the timing is gradually shifted in each field, so that the peak value is changed so as to come close to the desired timing by degrees. This sufficiently prevents the variations in the luminance from being visually recognized.

In the present embodiment, hysteresis widths may be set in the threshold values that classify the ranges. In the example of FIG. 16, 5° C. and 25° C. correspond to the threshold values.

For example, the hysteresis widths of 2° C. are provided over and under the threshold value of 5° C., respectively. In this manner, the hysteresis widths are set, so that the drive condition of the panel 1 can be changed as follows.

For example, when the temperature of the panel 1 varies from the value higher than 5° C. to the value not more than 5° C., the drive condition of the panel 1 is changed depending on the timing and the peak value of the ramp waveform shown in FIG. 16; however, when the temperature of the panel 1 subsequently rises, the drive condition of the panel 1 is not changed until the temperature of the panel 1 attains a value higher than 7° C.

Such a hysteresis control prevents the luminance of the image from being significantly changed when the temperature of the panel 1 is about 5° C. or about 25° C., for example. This sufficiently prevents the variations in the light emission luminance in the setup period from being visually recognized.

(Correspondences Between Elements in the Claims and Parts in Embodiments)

In the following paragraphs, non-limiting examples of correspondences between various elements recited in the claims below and those described above with respect to various preferred embodiments of the present invention are explained.

In the first to fourth embodiments, the potential $Vi_1$ is an example of a first potential, the potential $Vi_2$ is an example of a second potential, the ramp waveform rising from the potential $Vi_1$ to $Vi_2$ is an example of a first ramp waveform, the potential $Vi_3$ is an example of a third potential, the potential $Vi_4$ is an example of a fourth potential, and the ramp waveform dropping from the potential $Vi_3$ to $Vi_4$ is an example of a second ramp waveform.

Moreover, the ground potential is an example of a fifth potential, the potential $Vi_5$, $Vi_5'$, $Vh_5$, $Vl_5$ are examples of a sixth potential, the positive potential Ve is an example of a seventh potential, and the potential $Vi_6$, $Vi_6'$, $Vh_6$, $Vl_6$ are examples of an eighth potential.

As each of various elements recited in the claims, various other elements having configurations or functions described in the claims can be also used.

INDUSTRIAL APPLICABILITY

The present invention is applicable to a display device that displays various images.

The invention claimed is:

1. A plasma display device comprising:

a plasma display panel including a plurality of discharge cells at intersections of respective pluralities of scan electrodes and sustain electrodes and a plurality of data electrodes; and a driver that drives said plasma display panel by a sub-field method in which one field period includes a plurality of sub-fields, wherein said driver includes a scan electrode driving circuit that drives said plurality of scan electrodes, and a sustain electrode driving circuit that drives said plurality of sustain electrodes, said scan electrode driving circuit applies a first ramp waveform rising from a first potential to a second potential to said plurality of scan electrodes in a first period within a setup period of at least one sub-field of said plurality of sub-fields, and applies a second ramp waveform dropping from a third potential to a fourth potential to said plurality of scan electrodes in a second period following the first period, and said sustain electrode driving circuit applies a third ramp waveform rising from a fifth potential to a sixth potential to said plurality of sustain electrodes in a third period, which is shorter than said first period, and is within the first period, applies a fourth ramp waveform dropping from a seventh potential to an eighth potential to said plurality of sustain electrodes in a fourth period, which is shorter than the second period, and is within the second period, said plasma display device further comprising a detector that detects a cumulative lighting time of said plasma display panel as a state of said plasma display panel, wherein said sustain electrode driving circuit decreases a peak value of the third ramp waveform and a peak value of the fourth ramp waveform when the cumulative lighting time detected by said detector is longer than a predetermined threshold value so as to be lower than the peak value of the third ramp waveform and the peak value of the fourth ramp waveform when the cumulative lighting time detected by said detector is not longer than the predetermined threshold value.

2. The plasma display device according to claim 1, wherein said sustain electrode driving circuit brings said plurality of sustain electrodes into a floating state in the third period and the fourth period.

3. A driving method of a plasma display panel that drives the plasma display panel including a plurality of discharge cells at intersections of respective pluralities of scan electrodes and sustain electrodes and a plurality of data electrodes by a sub-field method in which one field period includes a plurality of sub-fields, the method comprising:

applying a first ramp waveform rising from a first potential to a second potential to the plurality of scan electrodes in a first period within a setup period of at least one sub-field of the plurality of sub-fields;

applying a second ramp waveform dropping from a third potential to a fourth potential to the plurality of scan electrodes in a second period following the first period;

applying a third ramp waveform rising from a fifth potential to a sixth potential to the plurality of sustain electrodes in a third period, which is shorter than the first period, and is within the first period;

applying a fourth ramp waveform dropping from a seventh potential to an eighth potential to the plurality of sustain electrodes in a fourth period, which is shorter than the second period, and is within the second period;

detecting a cumulative lighting time of the plasma display panel as a state of the plasma display panel; and decreasing a peak value of the third ramp waveform and a peak value of the fourth ramp waveform when the detected cumulative lighting time is longer than a predetermined threshold value so as to be lower than the peak value of the third ramp waveform and the peak value of the fourth ramp waveform when the detected cumulative lighting time is not longer than the predetermined threshold value.

4. A plasma display device comprising:

a plasma display panel including a plurality of discharge cells at intersections of respective pluralities of scan electrodes and sustain electrodes and a plurality of data electrodes; and a driver that drives said plasma display panel by a sub-field method in which one field period includes a plurality of sub-fields, wherein said driver includes a scan electrode driving circuit that drives said plurality of scan electrodes, and a sustain electrode driving circuit that drives said plurality of sustain electrodes, said scan electrode driving circuit applies a first ramp waveform that rises to said plurality of scan electrodes in a first half period within a setup period of at least one sub-field of said plurality of sub-fields, and applies a second ramp waveform that drops to said plurality of scan electrodes in a second half period following the first half period, and said sustain electrode driving circuit applies a third ramp waveform that rises to said plurality of sustain electrodes in the first half period, applies a fourth ramp waveform that drops to said plurality of sustain electrodes in the second half period, said plasma display device further comprising a detector that detects a cumulative lighting time of said plasma display panel as a state of said plasma display panel, wherein said sustain electrode driving circuit decreases a peak value of the third ramp waveform and a peak value of the fourth ramp waveform when the cumulative time detected by said detector is longer than a predetermined threshold value so as to be lower than the peak value of the third ramp waveform and the peak value of the fourth ramp waveform when the cumulative lighting time detected by said detector is not longer than the predetermined threshold value.

5. A driving method of a plasma display panel that drives the plasma display panel including a plurality of discharge cells at intersections of respective pluralities of scan electrodes and sustain electrodes and a plurality of data electrodes by a sub-field method in which one field period includes a plurality of sub-fields, the method comprising:

applying a first ramp waveform that rises to the plurality of scan electrodes in a first half period within a setup period of at least one sub-field of the plurality of sub-fields;

applying a second ramp waveform that drops to the plurality of scan electrodes in a second half period following the first half period;

applying a third ramp waveform that rises to the plurality of sustain electrodes in the first half period;

applying a fourth ramp waveform that drops to the plurality of sustain electrodes in the second half period;

detecting a cumulative lighting time of the plasma display panel as a state of the plasma display panel; and decreasing a peak value of the third ramp waveform and a peak value of the fourth ramp waveform when the detected cumulative lighting time is longer than a predetermined threshold value so as to be lower than the peak value of the third ramp waveform and the peak value of the fourth ramp waveform when the detected cumulative lighting time is not longer than the predetermined threshold value.

* * * * *